US007780517B2

(12) United States Patent
Saffari et al.

(10) Patent No.: US 7,780,517 B2
(45) Date of Patent: Aug. 24, 2010

(54) GAMING DEVICE HAVING A CASH OUT MENU SCREEN AND A SYSTEM AND METHOD FOR ENABLING A PLAYER TO RETRIEVE MONEY FROM A GAMING DEVICE

(75) Inventors: Mohammad Ali Saffari, Reno, NV (US); Richard W. Poole, Reno, NV (US); Larry R. Hollibaugh, Reno, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 747 days.

(21) Appl. No.: 10/767,243

(22) Filed: Jan. 27, 2004

(65) Prior Publication Data

US 2004/0204233 A1 Oct. 14, 2004

Related U.S. Application Data

(63) Continuation-in-part of application No. 10/439,357, filed on May 16, 2003, now Pat. No. 6,835,134, which is a continuation of application No. 09/819,175, filed on Mar. 27, 2001, now Pat. No. 6,579,179, which is a continuation-in-part of application No. 09/687,690, filed on Oct. 13, 2000, now abandoned.

(51) Int. Cl.
*A63F 9/24* (2006.01)

(52) U.S. Cl. ..... 463/25

(58) Field of Classification Search ..... 463/1, 463/16–20, 25–27, 29, 40, 42; 273/138.1, 273/148 R See application file for complete search history.

(56) References Cited

U.S. PATENT DOCUMENTS 4,492,378 A 1/1985 Williams (Continued)

FOREIGN PATENT DOCUMENTS

GB 2 096 376 A 10/1982

(Continued)

OTHER PUBLICATIONS

Description of Tokenization Feature in Gaming Machines written by IGT, published prior to 2000.

(Continued)

*Primary Examiner*—Dmitry Suhol
*Assistant Examiner*—Andrew Kim
(74) *Attorney, Agent, or Firm*—K&L Gates LLP

(57) ABSTRACT

An operator configurable cash out menu that is displayed when a player presses the cash out button of a gaming device. The present invention provides for more flexible cash outs than in known gaming systems, wherein the player can select one or more methods of payment. The player can select an amount of money to be transferred to a casino account. The player can also select an amount of money to issue on a ticket that the gaming device prints and provides to the player, whereby the player can redeem the ticket for cash. The present invention also enables the player to select different amounts of money to cash out. The player can choose: (i) to have some or all of the amount transferred to the casino account; (ii) to have some or all of the amount issue as cash printed on a ticket; or (iii) to have some be transferred to the account and some issue on a ticket.

55 Claims, 14 Drawing Sheets

U.S. PATENT DOCUMENTS

| | | | | |
|---|---|---|---|---|
| 4,636,951 | A | 1/1987 | Harlick | |
| 4,764,666 | A | 8/1988 | Bergeron | |
| 4,815,741 | A | 3/1989 | Small | |
| 4,837,728 | A | 6/1989 | Barrie et al. | |
| 4,882,473 | A | 11/1989 | Bergeron et al. | |
| 5,038,022 | A | 8/1991 | Lucero | |
| 5,159,549 | A | 10/1992 | Hallman, Jr. et al. | |
| 5,179,517 | A | 1/1993 | Sarbin et al. | |
| 5,275,400 | A | 1/1994 | Weingardt et al. | |
| 5,332,076 | A | 7/1994 | Ziegert | |
| 5,342,047 | A | 8/1994 | Heidel et al. | |
| 5,371,345 | A | 12/1994 | LeStrange et al. | |
| 5,377,973 | A | 1/1995 | Jones et al. | |
| 5,397,125 | A | 3/1995 | Adams | |
| 5,429,361 | A | 7/1995 | Raven et al. | |
| 5,470,079 | A | 11/1995 | LeStrange et al. | |
| 5,511,781 | A | 4/1996 | Wood et al. | |
| 5,546,523 | A | 8/1996 | Gatto | |
| 5,559,312 | A | 9/1996 | Lucero | |
| 5,575,717 | A | 11/1996 | Houriet, Jr. et al. | |
| 5,639,088 | A | 6/1997 | Schneider et al. | |
| 5,655,961 | A | 8/1997 | Acres et al. | |
| 5,674,128 | A | 10/1997 | Holch et al. | |
| 5,752,239 | A | 5/1998 | Coutts | |
| 5,766,074 | A | 6/1998 | Cannon et al. | |
| 5,770,533 | A | 6/1998 | Franchi | |
| 5,779,546 | A | 7/1998 | Meissner et al. | |
| 5,816,918 | A | 10/1998 | Kelly et al. | |
| 5,919,091 | A | 7/1999 | Bell et al. | |
| 5,951,397 | A | 9/1999 | Dickinson | |
| 5,984,779 | A | 11/1999 | Bridgeman et al. | |
| 5,993,316 | A | 11/1999 | Coyle et al. | |
| 6,012,832 | A | 1/2000 | Saunders et al. | |
| 6,014,594 | A | 1/2000 | Heidel et al. | |
| 6,015,344 | A | 1/2000 | Kelly et al. | |
| 6,048,269 | A | 4/2000 | Burns et al. | |
| 6,056,642 | A | 5/2000 | Bennett | |
| 6,068,552 | A | 5/2000 | Walker et al. | |
| 6,110,041 | A | 8/2000 | Walker et al. | |
| 6,110,044 | A | 8/2000 | Stern | |
| 6,113,098 | A | 9/2000 | Adams | |
| 6,125,307 | A | 9/2000 | Heidel et al. | |
| 6,126,166 | A | 10/2000 | Lorson et al. | |
| 6,128,550 | A | 10/2000 | Heidel et al. | |
| 6,139,419 | A | 10/2000 | Abe | |
| 6,168,522 | B1 * | 1/2001 | Walker et al. | 463/25 |
| 6,266,647 | B1 | 7/2001 | Fernandez | |
| 6,290,600 | B1 | 9/2001 | Glasson | |
| 6,293,866 | B1 | 9/2001 | Walker et al. | |
| 6,332,099 | B1 | 12/2001 | Heidel et al. | |
| 6,375,187 | B1 | 4/2002 | Baerlocher | |
| 6,450,887 | B1 | 9/2002 | Mir et al. | |
| 6,500,067 | B1 | 12/2002 | Luciano et al. | |
| 6,500,068 | B2 | 12/2002 | Walker et al. | |
| 6,511,377 | B1 * | 1/2003 | Weiss | 463/25 |
| 6,530,842 | B1 | 3/2003 | Wells et al. | |
| 6,537,151 | B1 | 3/2003 | Walker et al. | |
| 6,558,255 | B2 | 5/2003 | Walker et al. | |
| 6,558,256 | B1 | 5/2003 | Saunders | |
| 6,579,179 | B2 * | 6/2003 | Poole et al. | 463/25 |
| 6,582,301 | B2 | 6/2003 | Hill | |
| 6,599,192 | B1 | 7/2003 | Baerlocher et al. | |
| 6,609,978 | B1 | 8/2003 | Paulsen | |
| 6,620,047 | B1 | 9/2003 | Alcorn et al. | |
| 6,623,357 | B2 | 9/2003 | Chowdhury | |
| 6,626,757 | B2 | 9/2003 | Oliveras | |
| 6,648,754 | B2 | 11/2003 | Baerlocher et al. | |
| 6,743,097 | B2 | 6/2004 | Walker et al. | |
| 6,752,312 | B1 | 6/2004 | Chamberlain et al. | |
| 7,147,558 | B2 * | 12/2006 | Giobbi | 463/25 |
| 7,261,635 | B2 | 8/2007 | Walker et al. | |
| 2002/0173352 | A1 | 11/2002 | Oliveras | |
| 2002/0177479 | A1 | 11/2002 | Walker et al. | |
| 2003/0092477 | A1 | 5/2003 | Luciano, Jr. et al. | |
| 2003/0199320 | A1 | 10/2003 | Nguyen et al. | |
| 2003/0209599 | A1 | 11/2003 | Gatto | |
| 2005/0079908 | A1 | 4/2005 | Pacey | |

FOREIGN PATENT DOCUMENTS

| | | | |
|---|---|---|---|
| GB | 2 142 457 | A | 1/1985 |
| GB | 2 161 008 | A | 1/1986 |
| GB | 2 161 009 | A | 1/1986 |
| GB | 2 180 682 | A | 4/1987 |
| GB | 2 181 589 | A | 4/1987 |
| GB | 2 183 882 | A | 6/1987 |
| GB | 2 222 712 | | 3/1990 |
| WO | WO 85/00910 | | 2/1985 |

OTHER PUBLICATIONS

Screen of Addams Family Game illustrating Cash Out Button publ, published prior to 2000.

Winners Choice Screen published by IGT, published prior to 2000.

Non-Final Office Action dated Dec. 23, 2003 from U.S. Appl. No. 10/439,357, pp. 1-9.

Non-Final Office Action dated Jun. 26, 2008 from U.S. Appl. No. 11/014,078, pp. 1-10.

Non-Final Office Action dated Jun. 7, 2002 from U.S. Appl. No. 09/819,175, pp. 1-12.

* cited by examiner

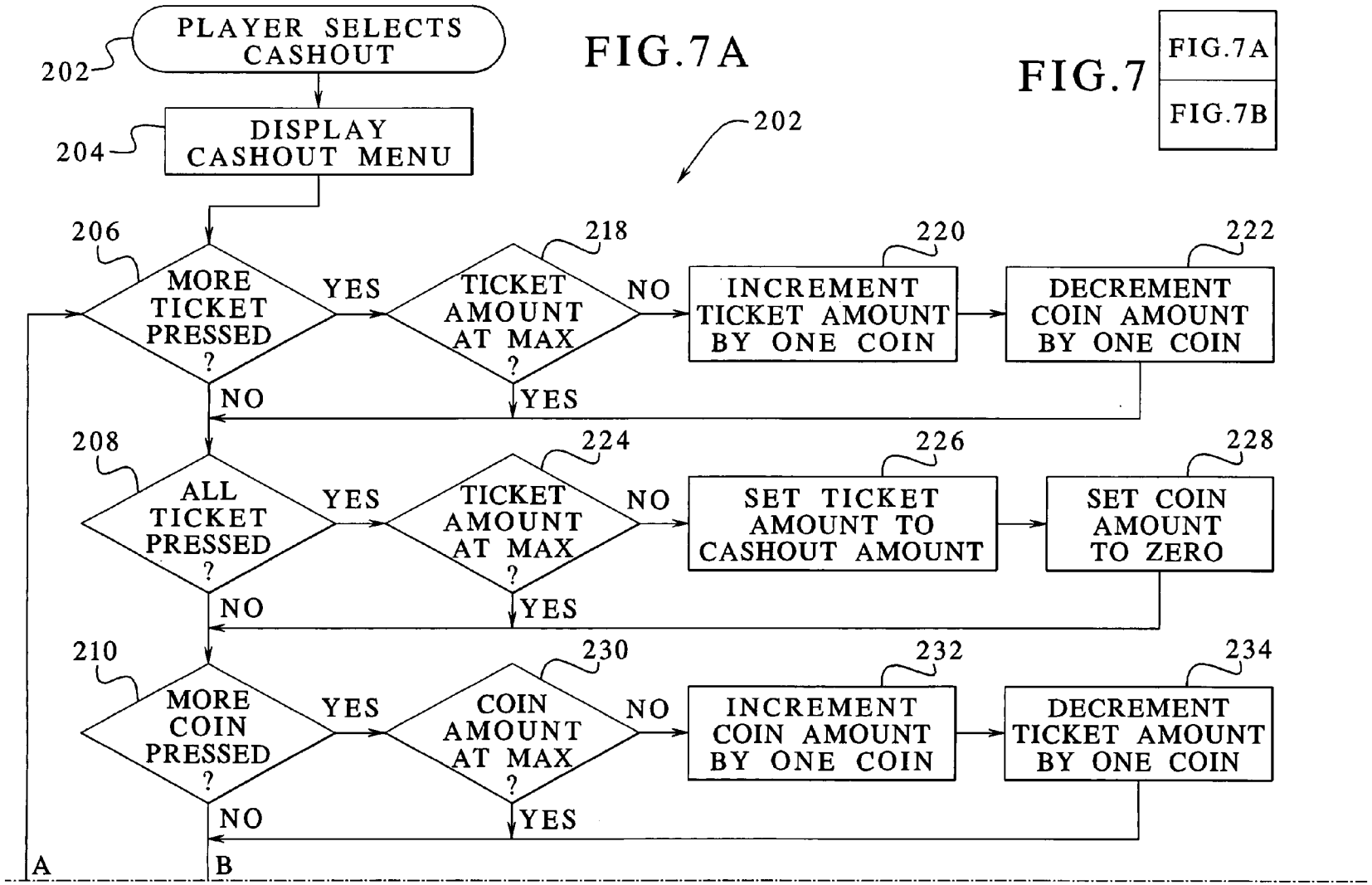
FIG.7A
FIG.7B
FIG.7
FIG.7A
202
PLAYER SELECTS CASHOUT
202
DISPLAY CASHOUT MENU
204
MORE TICKET PRESSED ?
206
YES
NO
TICKET AMOUNT AT MAX ?
218
NO
YES
INCREMENT TICKET AMOUNT BY ONE COIN
220
DECREMENT COIN AMOUNT BY ONE COIN
222
ALL TICKET PRESSED ?
208
YES
NO
TICKET AMOUNT AT MAX ?
224
NO
YES
SET TICKET AMOUNT TO CASHOUT AMOUNT
226
SET COIN AMOUNT TO ZERO
228
MORE COIN PRESSED ?
210
YES
NO
COIN AMOUNT AT MAX ?
230
NO
YES
INCREMENT COIN AMOUNT BY ONE COIN
232
DECREMENT TICKET AMOUNT BY ONE COIN
234
A
B

GAMING DEVICE HAVING A CASH OUT MENU SCREEN AND A SYSTEM AND METHOD FOR ENABLING A PLAYER TO RETRIEVE MONEY FROM A GAMING DEVICE

PRIORITY CLAIM

This application is a continuation-in-part of U.S. patent application Ser. No. 10/439,357, filed May 16, 2003, now U.S. Pat. No. 6,835,134, which is a continuation of U.S. patent application Ser. No. 09/819,175, filed Mar. 27, 2001, now U.S. Pat. No. 6,579,179, which is a continuation-in-part of U.S. patent application Ser. No. 09/687,690, filed Oct. 13, 2000 now abandoned.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a cash out menu screen, wherein a player can selectively retrieve some or all of the amount of money held by the gaming device in one or more forms of payment.

BACKGROUND OF THE INVENTION

It is well known to provide a gaming device, most typically a slot machine or card gaming machine, that accepts money from a player, holds the money while the player plays the gaming device and enables the player to retrieve the player's money at any time. The games in one embodiment do not require the player to input or insert a wagerable amount of money in the gaming device each time the player wishes to play the game. When the player wins while playing known gaming devices, the gaming devices do not require the player to take the winnings and reinvest them into the gaming device if the player desires to continue play. Known gaming devices therefore provide a credit meter or display, which is a mechanism that maintains and displays a pool of money in the gaming device. The pool can store an amount sufficient to play many games of the gaming device. The pool can also accumulate and store the player's winnings. When the player wishes to stop playing, known gaming devices provide a mechanism by which the player can retrieve the money that remains in the pool.

Historically, known retrieval mechanisms include a cash out mechanism, which pays out the player's money in a desired denomination or form of money. Dollar slot machines (requiring at least a $1 wager) typically issue tokens redeemable for $1 when the player cashes out. Other slot machines can issue actual money such as nickels, dimes, quarters and half dollars. Known slot machines maintain a payout tray limit, such that an operator or attendant is called when the player wins or wishes to cash out an amount above the limit. The limit prohibits the player from having to handle a cumbersome or unsafe amount of coins and enables the machine to store a minimal number of coins at any one time.

Other modern slot machines contain a ticketing system, such that the machine issues a ticket to the player that includes the amount of the player's money printed on the ticket. The player can input money using coins, tokens, paper money or credit or debit cards. In one embodiment, when the machine issues the ticket, the player can input the ticket into other gaming machines equipped for redeeming the tickets, or redeem the ticket for money from an operator attendant. The ticketing systems advantageously enable gaming to take place without the player having to handle tokens or coins.

Known retrieval mechanisms generally present an all or nothing proposition to the player. A player needing money from the machine has to retrieve the total amount that has been inputted into the machine. If the player needs less than all the amount from the machine and still desires to play the machine, the player must retrieve the total amount from the machine and re-input the amount with which the player wishes to continue play. A player needing less than all the amount of money from a known ticketing machine, who still desires to play the machine, must retrieve a ticket from the machine containing the total amount that has been inputted into the machine. When a gaming device allows a coin or a ticket payout, a need exists to allow the player to choose between a coin pay, a ticket pay or both.

A need exists for a more flexible cash out or money retrieval system in known gaming machines and more specifically slot machines having modern ticketing systems. Specifically, a need exists in modern ticketing machines to enable the player to retrieve an amount of money in a form immediately usable by the player, e.g., coin money, tickets, or tokens. These amounts enable the player to make monetary transactions such as playing a neighboring machine and tipping an attendant without having to remove all the money from the machine they are playing. A need also, therefore, exists in gaming machines to enable the player to retrieve less than all the money that has been inputted into or won at the machine. In particular, a need exists to enable a player to quickly retrieve a partial definable amount for the player to use without completely cashing out and/or leaving the gaming device.

SUMMARY OF THE INVENTION

The present invention is operator configurable such that the gaming device displays a cash out screen or interface in one embodiment every time the player presses the cash out button of the gaming device. After pressing the cash out button, the game presents a screen of the present invention, which provides for more flexible cash outs than in known gaming systems. The present invention enables the player to select one or more methods of payment. The player can select an amount of coins to issue from a coin payout tray of the game. The player can also select an amount of money to issue on a ticket that the gaming device prints and provides to the player, whereby the player can redeem the ticket for cash, or input the ticket into another gaming machine. It should be appreciated that the present invention is not limited to providing a ticket to the player, but also can be adapted wherein the player can select an amount of money to issue on a credit card, debit card, smart card, note, payout system or any other suitable amount recording device. For purposes of this application, amount recording device also includes pay out systems, such as hand pay systems and automatic systems which pay out paper money such as dollar bills. A hand pay may be employed for instance when there is not enough coins in the gaming device to pay the player in coins. The gaming machine may notify the player in such case. The amount recording device may further include a memory device which stores an amount of money in a player's account. For purposes of this application, ticket and amount recording device are used interchangeably herein; although the amount recording device includes but is not limited to a ticket and other payout systems.

The present invention enables the player to select different amounts of money to cash out. Depending upon the amount of money a player has in the gaming device, the player can choose: (i) to have some or all of the amount issue as coins from the coin payout tray; (ii) to have some or all of the amount issue as cash represented by a ticket or stored in an amount recording device; or (iii) to have some issue as coins and some issue as cash represented by a ticket or stored in an amount recording device. In one embodiment, the present invention issues the coins into the coin payout tray first and then the ticket.

The present invention also in one embodiment includes a quick coin feature, which enables the player to obtain an operator configurable amount of coins (e.g., $0.50) in the coin payout tray. The present invention also contemplates a quick coin feature, which enables the player to obtain a player definable amount of coins in the coin payout tray. The present invention also contemplates a quick ticket feature, which enables the player to obtain an operator configurable or player definable ticket payout.

The present invention in one embodiment includes a more coins feature that enables the player to sequentially add coin amounts, in the coin payout tray denomination, to the amount of coins that the game issues. The present invention issues coins in the operator configurable coin payout tray denomination. The amount of coins that the game issues at one time cannot exceed a coin payout tray limit. The present invention also in one embodiment includes a max coins feature that enables the player to easily receive the maximum allowable amount of coins from the game. The maximum allowable amount of coins is limited by: (i) the coin payout tray limit; (ii) the coin payout denomination; and (iii) the current cash out amount.

The present invention in one embodiment includes a more ticket feature that enables the player to sequentially add ticket amounts, in the smallest machine allowable denomination, to the amount of cash that the game issues on the ticket. The smallest machine allowable denomination is the smallest amount of money that a machine can pay by coin, which cannot be smaller than the coin payout tray denomination. The present invention also in one embodiment includes an all ticket feature that enables the player to receive the entire amount of money held in the gaming device on a ticket.

The present invention in one embodiment totals the amount currently selected to be issued as coins and the amount currently selected to be issued on a ticket and displays the totaled amount to the player. The cash out screen of the present invention in one embodiment includes a second executable cash out feature, which is locationally separate from the electromechanical cash out button or selector of the gaming device, and which sends a command to the game to execute the current cash out distribution. The player can also cancel a cash out (except one that is in progress) via a return to game feature.

In another embodiment of the present invention, the cash out menu enables the player to select a portion of the cash out to be paid out in a first form and a second portion of the cash out to be credited to a casino account. In one embodiment, the first form of payout is a ticket payout. In that embodiment, the cash out menu enables the player to receive a ticket with some or all of the player's total cash out amount and credit some or all of the player's cash out amount to the casino account. In alternative embodiments, the cash out menu enables the player to receive a portion or all of the cash out in one or more other forms, such as coins, tokens, a credit card crediting, a debit crediting, a player tracking card crediting, a promotional ticket, a jackpot ticket and any combination thereof.

The present invention expressly contemplates providing, one, two, three or more forms of payment, wherein one of the forms is the crediting of a casino account. For example, the gaming device could enable the player to split funds between receiving a portion on a ticket and crediting a portion to the casino account, while at the same time providing the player with a quick coin feature that pays out coins or tokens to the player to purchase a refreshment, tip a host, etc. That quick coin feature provides a third form of payment from the gaming device to the player.

It is also possible via the present invention to make a partial or total cash out split between multiple gaming devices. For example, it is common for a player to play two machines at once. The player who has a casino account may wish to transfer funds from one machine to the other without having to insert the casino card into the transferor machine, transfer money to the card from that machine, and thereafter remove the card from the transferor machine and reinsert the card into the transferee machine. Accordingly, the present invention contemplates enabling two or more machines to be credited via the player's casino card, after which a casino network, which links the player's casino card to a central server computer that tracks the player's casino account, enables funds to be transferred directly over the network between the two or more machines without requiring the player to reinsert the casino card into the machines. For example, when the network knows that the player has credited two or more machines with the casino card, the network tells the machines upon a cash out to display a special screen having an option to transfer funds between the machines.

The accessing of the casino account is performed in one of a plurality of ways. In one way, the player uses the currently existing player tracking card and network therefore to also access the player's casino account. That is, the casino's player tracking card program also encompasses and accounts for the player's money stored at the casino account. In another embodiment, a separate card or other suitable device is provided to the player, which acts like a debit or credit card, and which is specific to the particular casino or perhaps a network of different casinos. In either case, the system in one embodiment provides a PIN number that the player enters to enable funds to be withdrawn from the casino account. The system additionally or alternatively uses other methods of player identification, such as finger print recognition, retinal scan and the like.

The casino account in one embodiment is both a cash account and credit account. That is, the player can keep a balance of money on the account. Additionally, the account can provide a limit of credit to the player, such as with a credit card. Thus, when the player returns to the machine and inserts the casino account card, the display device initially prompts the player to choose between credit and debit. That is, the gaming device determines whether the player wishes to play with the player's stored funds or use borrowed funds.

The gaming device is suitably networked with other gaming devices and one or more server computers via a suitable communications link according to the configuration of the casino accounting system. In one embodiment, the casino account system is combined with the casino's player tracking system, wherein the communications link is the link between the machines and the server computer dedicated to run the player tracking system. In another embodiment, the casino account system is combined with the ticketing system, wherein the communications link is the ticket validation system or network that links the computer to a server running the ticketing system. In a further alternative embodiment, a separate network, such as a fiberoptic, DSL, computer modem or other type of communications link is used to link the computers to a central or server computer.

The central or server computer can be located on a local area network, wide area network, or internet link to the gaming devices having the cash out system of the present invention. Thus, it is possible for a player to cash out of a machine at a first casino, thereby sending an amount of the cash out to the casino account, and thereafter retrieve that amount on a gaming device located at a different casino. It is also possible to link the server computer to non-gaming areas within the casino so that the player can access the casino account, for example, at a restaurant, a shop within the casino, a product supplier such as a clothing store or a service provider such as a beauty parlor, laundromat, or exercise facility. Those non-gaming outlets can be located within the casino where the cash out is made or at a remote casino which cooperates with the cash out casino.

It is therefore an advantage of the present invention to provide a gaming device with a cash out menu, wherein a player can selectively and flexibly retrieve some or all of the amount of money held by the gaming device in one or more forms of payment.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
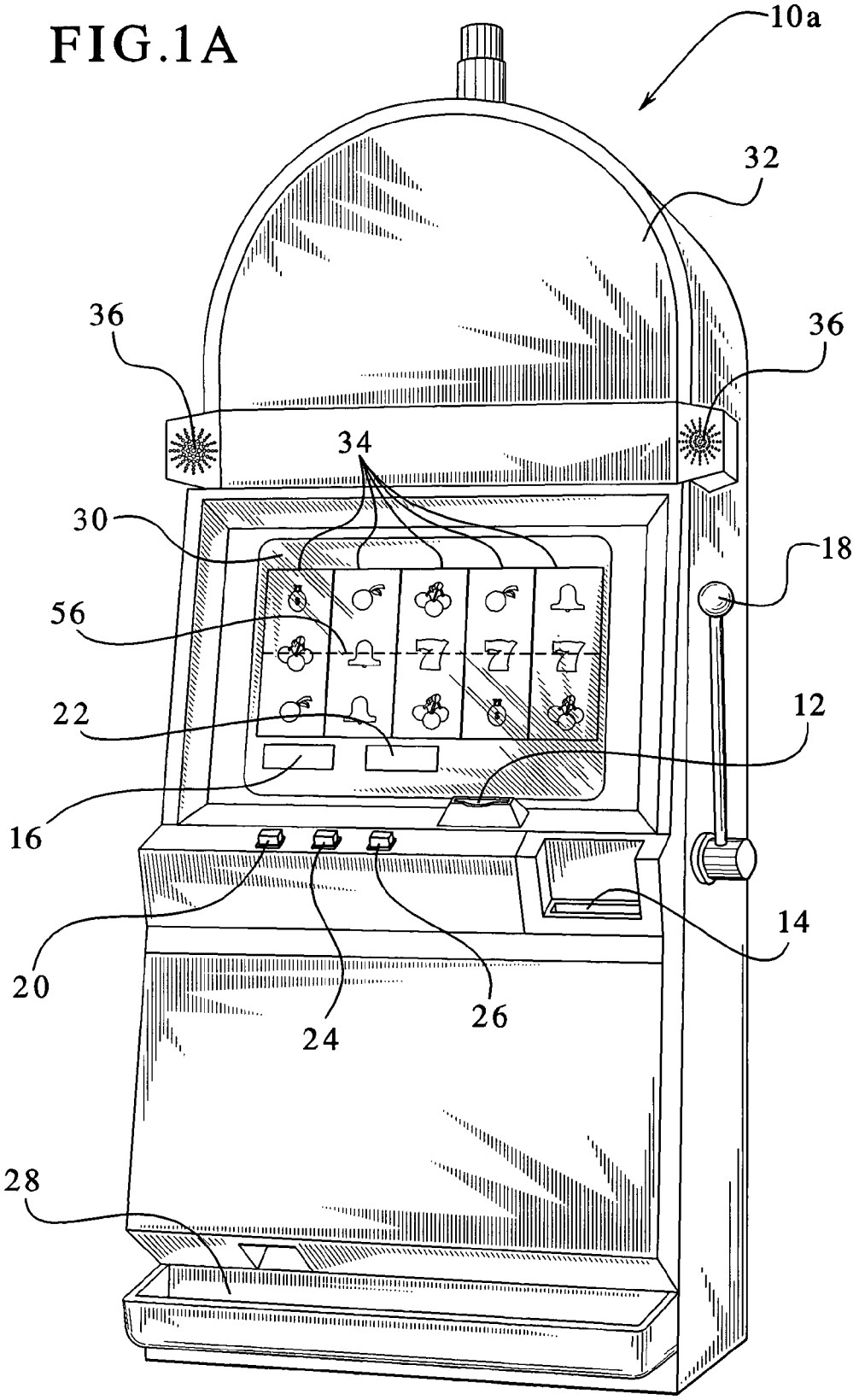
FIG. 1A is a front-right side perspective view of one embodiment of the gaming device of the present invention.
Figure 1B:
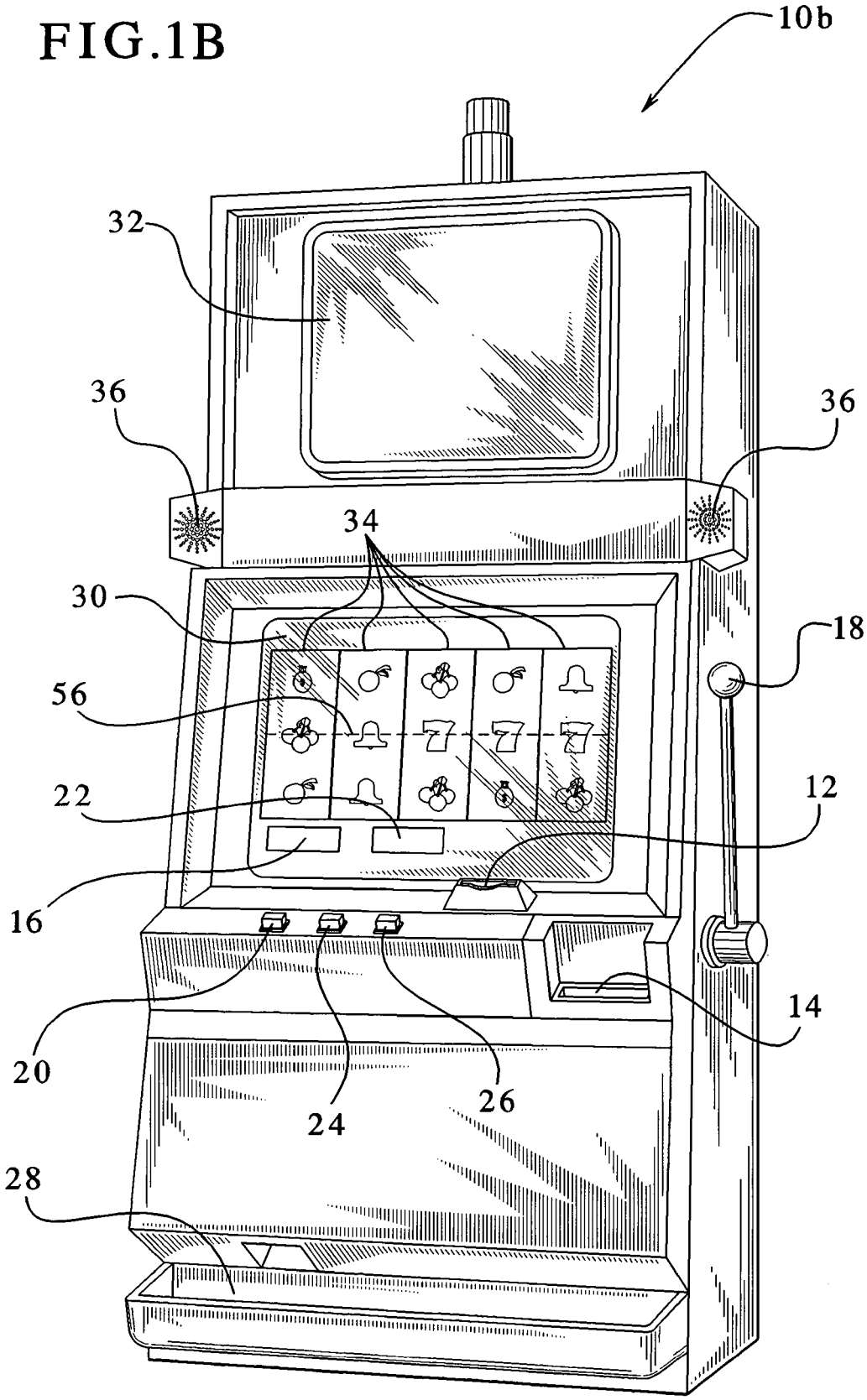
FIG. 1B is a front-right side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and gaming device 10 is in one embodiment mounted on a console. However, it should be appreciated that gaming device 10 can be constructed as a pub-style table-top game (not shown) which a player can operate while sitting. Furthermore, gaming device 10 can be constructed with varying cabinet and display designs, as illustrated by the designs shown in FIGS. 1A and 1B.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards, debit cards, smart cards, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time before or after game play, a player may "cash out" by pushing a simulated, electromechanical or any other suitable cash out button 26 to invoke the cash out menu of the present invention. Coin cash outs are paid to hopper 28 in one embodiment.

Gaming device 10 also includes one or more display devices. The embodiment shown in FIG. 1A includes a central display device 30, and the alternative embodiment shown in FIG. 1B includes a central display device 30 as well as a secondary display device 32. Gaming device 10 in one embodiment displays a plurality of reels 34, e.g., three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. In a video poker or other card gaming machine embodiment, the display device can display one or more cards. A display device can be any viewing surface such as glass, a video monitor or screen, a liquid crystal display or any other static or dynamic display mechanism. If the reels 34 are in video form, the display device for the video reels 34 is in one embodiment a video monitor.

Each reel 34 displays a plurality of indicia such as bells, hearts, fruits, numbers, letters, bars or other images which in one embodiment correspond to a theme associated with the gaming device 10. Furthermore, gaming device 10 in one embodiment includes speakers 36 for making sounds or playing music.

Figure 2:
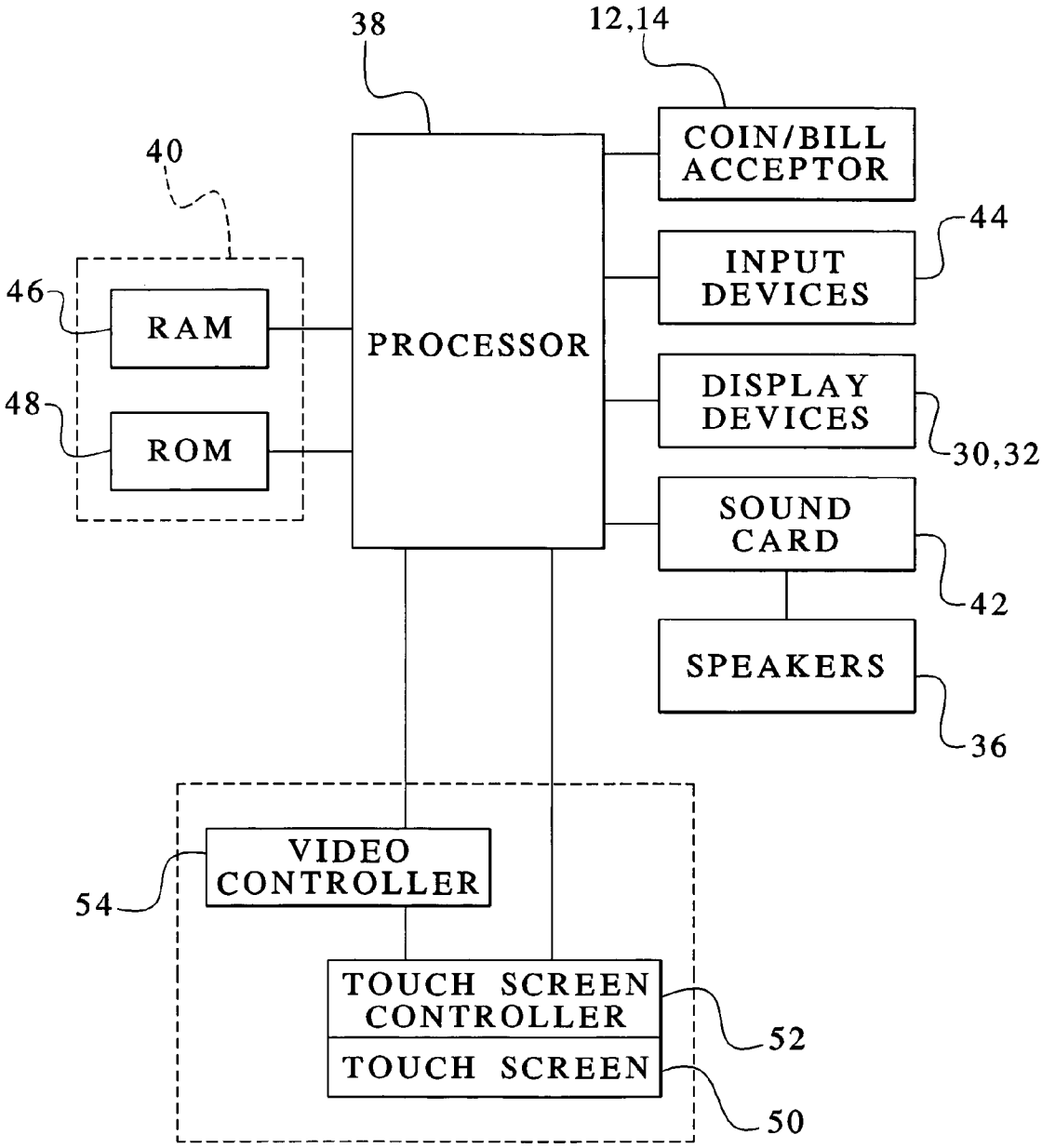
FIG. 2 is a schematic block diagram of the electronic configuration of one embodiment of the gaming device of the present invention.

As illustrated in FIG. 2, the general electronic configuration of gaming device 10 includes: a processor 38; a memory device 40 for storing program code or other data; one or more display devices 30 and/or 32; a sound card 42; a plurality of speakers 36; and one or more input devices 44. The processor 38 is in one embodiment a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

It should be appreciated that the present invention in one embodiment uses graphic and sound elements to construct the cashout menu described below. These elements may be stored in EEPROM, flash memory, hard disk, CD ROM or in other suitable storage devices. The cash out menu is in one embodiment constructed in real time when needed. The cashout menu can be displayed on any suitable display device such as a CRT (cathode ray tube), LCD (liquid crystal display), VFD (vacuum fluorescent display), LED (light emitting diode) display, or it could be implemented using only dedicated electromechanical switches.

As illustrated in FIG. 2, the player uses the input devices 44, such as pull arm 18, play button 20, the bet one button 24 and the cash out button 26 to input signals into gaming device 10. In certain instances, it is preferable to use a touch screen 50 and an associated touch screen controller 52 associated with a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 and/or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 in one embodiment reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. Depending upon where the reels 34 stop, the player may or may not win additional credits. As long as the player has the required amount of credits remaining, the player can spin the reels 34 again.

In addition to winning credits in this manner, in one embodiment gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 in one embodiment uses a video-based central display device 30 to enable the player to play the bonus round. In one embodiment, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Cash Out Menu of the Present Invention

Figure 3:
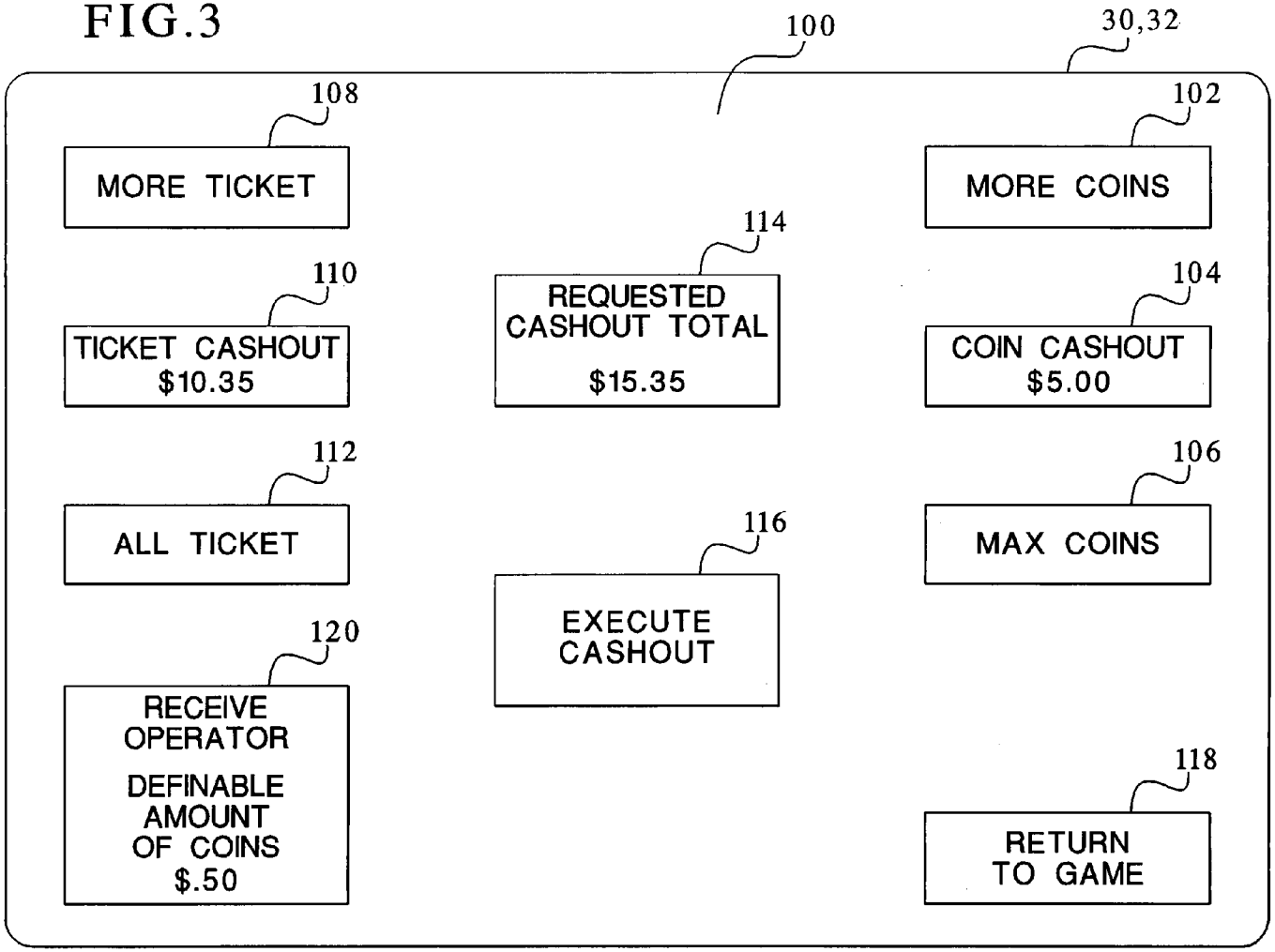
FIG. 3 is a front elevation view of a display device illustrating a cash out menu embodiment of the present invention.

Referring now to FIG. 3 an enlarged front elevational view of the central display device 30 or the secondary display device 32 of FIGS. 1A and 1B, respectively, is shown illustrating the a cash out menu embodiment 100 of the present invention. When the player decides to cash out and selects the cash out button or selector 26 of FIGS. 1A and 1B, the gaming device presents the cash out menu to the player. A method for operating the cash out menu is discussed below in connection with FIG. 7.

The present invention is in one embodiment embodied in a video monitor having a touch screen 50 and an associated touch screen controller 52, as discussed above in connection with FIG. 2. Each of the player selectable buttons or selectors hereafter described is therefore in one embodiment a separate area of the touch screen 50, such that touching that area sends a separate signal or input to the controller of the present invention. Alternatively, the monitor can include only the displays of the present invention, wherein separate electromechanical input devices 44 (FIG. 2) are dedicated to each of the player selectable buttons or selectors.

The cash out menu 100 of FIG. 3 includes a plurality of devices relating to the retrieval of coins or tokens (i.e., money in metal form) from the gaming device 10. As discussed above, slot machines typically employ tokens for wagers of $1.00 or more. Nickel, quarter and half dollar machines typically deal in real money. Depending on the minimum wager of the slot machine, the present invention can issue coins or tokens. Hereafter, if for ease and clarity only "coins" is described or illustrated, it should be appreciated that the present invention refers to both coins and tokens.

The more coins selector 102 of FIG. 3 enables the player to increment the retrieval amount of coins or tokens by the minimum payout tray denomination of the associated slot machine. For a dollar slot machine employing tokens, the more coins selector 102 enables the player to increment the retrieval amount by dollars, e.g., $1, $2, $3, etc. For a quarter slot machine employing quarters, the more coins selector 102 enables the player to increment the retrieval amount by $0.25 (e.g., $0.25, $0.50, $0.75, etc.).

The coin indicator 104 of FIG. 3 displays the current retrieval amount in dollars and cents. For a $1 token machine, the present invention does not in one embodiment display an amount in tokens; rather, the coin indicator 104 in one embodiment automatically converts the number into dollars and cents. The coin indicator 104 in one embodiment updates as the player selects or presses the more coins selector 102.

The max coins selector 106 enables the player to receive the maximum allowable amount of money in the form of coins or tokens. Although the max coins selector 106 relates to coins or tokens, it operates separate from the more coins selector 102. The max coins selector 106 sets as many coins or tokens as possible to the max coin amount immediately after the player selects or presses the max coins selector 106.

The number of coins set by the max coins selector 106 is limited by three constraints, namely: (i) the coin payout tray limit; (ii) the coin payout denomination; and (iii) the total cash out amount. Two examples illustrate the constraints. First, if the player has $2,000 in the machine and desires a coin cash out, but the machine only allows a $1,000 coin cash out, the present invention observes the machine limit and sets the coin amount to a $1,000 coin cash out. The game sets the ticket pay amount to the remaining $1,000. Second, if on a $1 machine the player has $15.35 in the machine and selects the max coins selector 106, the game sets the coin cash out amount to $15.00. The game sets the ticket pay amount to $0.35, as discussed below.

The cash out menu 100 of FIG. 3 also includes a plurality of devices relating to the retrieval of money in the form of a redeemable amount printed on a ticket from the gaming device 10. As discussed above, many modern slot and card machines contain well known ticketing systems that enable a safe reliable payout, which is convenient for large payouts. The system prints out the amount of money to redeem on the ticket. Gaming establishments typically maintain cashiers near the machines to redeem the ticket.

The more ticket selector 108 of FIG. 3 enables the player to increment the retrieval amount of ticket pay by the payout tray denomination of money, i.e., the coin payout denomination. In the example of a dollar slot machine employing tokens, described above, it is conceivable that certain winning combinations of symbols appearing on the reels of multi-denominational gaming devices provide awards in fractions of a token, e.g., in quarters, dimes or nickels. As described above, the coin cash out does not enable fractions of the payout tray denomination. The more ticket selector 108 of FIG. 3, however, is capable of issuing a ticket in a fraction of the payout tray denomination, if necessary. Generally, however, the more ticket selection 108 of FIG. 3 in one embodiment enables the player to increment in the coin payout denomination because the coin indicator 104 and the more coins selector 102 are only able to decrease by the coin payout denomination.

If desired by the implementor, the present invention enables the player to maintain pressure on the selectors 102 and 108 and automatically and continuously pulse incrementing inputs into the controller, so that the player does not have to individually input or press each increment. The present invention can further time the player's input and speed up the pulse rate after a predetermined amount of time, e.g., three seconds, to minimize the time that the player has to maintain pressure. The present invention includes a plurality of pulse accelerations after different predetermined amounts of time.

The ticket indicator 110 of FIG. 3 displays the current retrieval amount in dollars and cents. Again, for a token machine, the present invention does not in one embodiment display an amount in tokens; rather, the ticket indicator 110 in one embodiment automatically converts the number into dollars. The ticket indicator 110 in one embodiment updates as the player selects or presses the more ticket selector 108.

The all ticket selector 112 enables the player to receive the entire amount of money currently available for wager in the form of an amount printed on a ticket. Although the all ticket selector 112 relates to ticket money, it operates separate and apart from the more ticket selector 108. The all ticket selector 112 sets all money that the player has currently available for ticket pay as of the moment the player selects the all ticket selector 112. The coin payout tray limit and the coin payout tray denomination do not limit the all ticket selector 112, as they do the max coins selector. In the example above, wherein on a $1 machine the player has $15.35 inputted into the machine and selects the all ticket selector 112, the game sets the ticket pay amount to the entire amount of $15.35.

The present invention in one embodiment structures the cash out such that the sum of the coin pay amount and ticket pay amount equals the player's total currently stored credits or money, which the game displays in the credit display 16. In one embodiment, when the player selects the more coins selector 102 and increments the coin pay by one coin or token, the game necessarily decreases the ticket pay by one coin or token. Likewise, when the player selects the more ticket selector 108 and increments the ticket pay by one coin or token, the game necessarily decreases the coin pay by one coin or token. In one embodiment, selecting the max coins selector 106 automatically sets the coin pay to a maximum allowable amount as defined by the coin payout tray limit; coin payout denomination; and total cash out amount and sets the ticket pay to the remaining amount, if any, of the player's money. Selecting the all ticket selector 112 sets the ticket pay to the player's total currently stored credits or money, which the game displays in the credit display 16, and sets the coin pay to zero.

In an alternative embodiment, the present invention structures the cash out such that the sum of the coin pay amount and ticket amount does not equal the player's total currently stored money displayed in the credit display 16. In this alternative embodiment, the max coin feature of the max coins selector 106 and the all ticket pay feature of the all ticket selector 112 operate the same as in the illustrated structure. In one embodiment, increasing one type of payout necessarily decreases another type of payout, such that the two types add to the player's total stored money. In the alternative embodiment, the more coins selector 102 and the more ticket selector 108 add to an amount initially set to a fraction of a total cashout, e.g., fifty percent of a total cash out. Thus, when the player selects the more coins selector 102 and increments the coin pay by one coin or token, in the alternative embodiment, the game only decreases the ticket pay by one coin or token if the sum of the coin pay and the ticket pay is already equal to the player's total stored money. Likewise, when the player selects the more ticket selector 108, and increments the ticket pay by one coin or token, in the alternative embodiment, the game only decreases the coin pay by one coin or token if the sum of the coin pay and the ticket pay is already equal to the player's total stored money. This embodiment enables the player to take out or receive partial payments from the gaming device and continue to play the gaming device.

The total cash out display 114 indicates the summation of the amount displayed by the coin indicator 104 and the ticket indicator 110. If the player has not inputted a coin cash out amount but has inputted a ticket cash out amount, the total cash out display 114 indicates the ticket cash out amount and vice versa. The player executes either or both a coin cash out or ticket cash out by selecting the cash out executor 116. The game can issue coins first and then the ticket, the ticket first and then the coins or both simultaneously. The game can provide a suitable audio, visual or audiovisual message informing the player to retrieve the ticket.

The return to game or cancel executor 118 enables the player to cancel a cash out before an issuance of coins or a ticket. Thus, at any point before selecting the cash out executor 116, the player can abort the cash out and return to the game. If the player cashes out less than all the money currently inputted into the gaming device, the present invention in one embodiment returns the player to the primary game to resume gaming.

The quick coin executor 120 enables the player to quickly obtain an operator definable amount of coins or tokens from the player's money currently held by the gaming device. The quick coin executor 120 in one embodiment pays out a multiple of the payout denomination. In one embodiment, the amount is relatively small, e.g., $0.50 to $1.00, to provide a convenient source of money for the player. If the player needs more money, the player can easily select the quick coin executor 120 a plurality of times or execute a coin cash out using the selector 102 and executor 116. The quick coin executor 120 in one embodiment displays the defined amount, illustrated in FIG. 3 as $0.50.

The present invention contemplates the quick coin feature amount alternatively being player configurable or definable rather than operator configurable. In such a case, the present invention includes a separate selector or selectors (not illustrated) enabling the player to increment the quick coin amount in the payout denomination or to type in a multiple of the payout tray denomination. The present invention further contemplates providing both options to the casino operator and enabling the operator to set or choose to have the amount be operator or player configurable.

The present invention further alternatively contemplates the embodiment 100 of FIG. 3, including a quick ticket feature (not illustrated) that enables the player to quickly retrieve an operator or player configurable amount of money onto a redeemable ticket. The embodiment 100 in such a case includes a quick ticket executor, similar to the executor 120, which in one embodiment displays the operator or player defined amount to the player. If the amount is player configurable, this alternative embodiment 100 can also include a separate selector or selectors enabling the player to increment or type in any machine allowable amount. As illustrated above, the operator can preset the ticket amount to be operator or player configurable.

Figure 4:
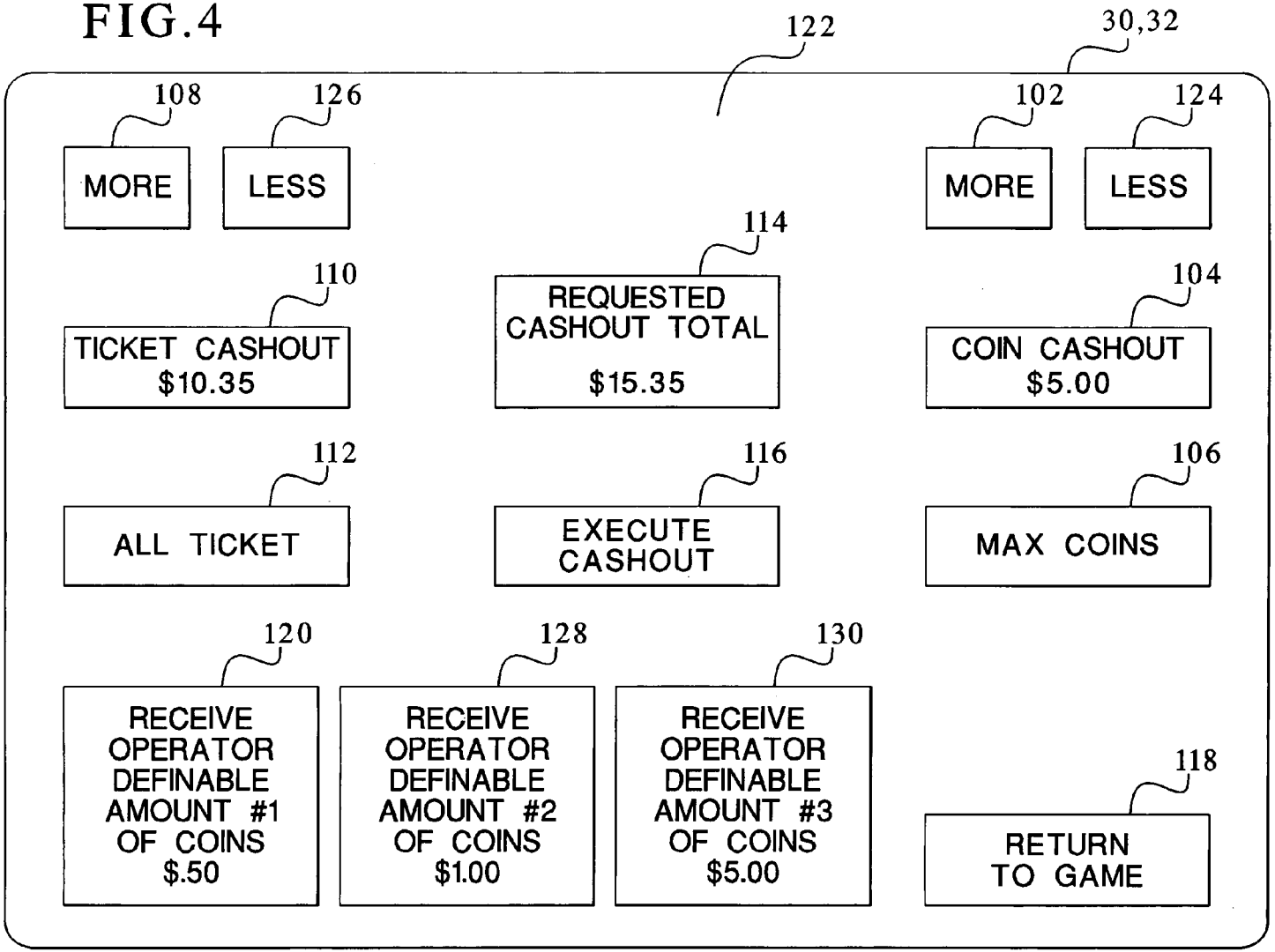
FIG. 4 is a front elevation view of a display device illustrating an alternative cash out menu embodiment of the present invention.

Referring now to FIG. 4, an enlarged front elevational view of the central display device 30 or the secondary display device 32 of FIGS. 1A and 1B, respectively, is shown illustrating an alternative cash out menu 122 of the present invention. The alternative cash out menu 122 includes a reversing or adjusting feature activated by the less coins selector 124 and the less ticket selector 126. If the player overshoots an amount or has a change of mind, the player can adjust accordingly without having to begin anew. The associated coin indicator 104 and ticket indicator 110 follow and display the player's adjustment accordingly.

The reversing or adjusting feature is particularly useful in situations wherein the player desires to increment a substantial but less than a total cash out. As with the embodiment of FIG. 3, the alternative cash out menu 122 of FIG. 4 includes enabling the player to maintain pressure on the selectors 102 and 108 and automatically and continuously pulse incrementing inputs into the controller, so that the player does not have to individually input or press each increment. The present invention can further time the player's input and speed up the pulse rate after a predetermined amount of time, e.g., three seconds, to minimize the time that the player has to maintain pressure. The present invention includes providing a plurality of pulse accelerations after different predetermined amounts of time.

After accelerating the pulsed incrementing inputs to a certain point, the player may not be capable of stopping the pulses so that the amount indicated by the coin indicator 104 or ticket indicator 110 displays the exact amount desired by the player. The player may overshoot the desired amount. In this case, it is desirable to provide the less coins selector 124 and the less ticket selector 126, or an "alternate more" selector, so that the player can back-up accordingly without having to begin anew.

The alternative cash out menu 122 of FIG. 4 also includes a plurality of quick coin executors 128 and 130, in addition to the executor 120. As stated above, the quick coin executors enable the player to quickly obtain an operator definable amount of coins or tokens from the player's money currently held by the gaming device. Providing a plurality of such executors provides a plurality of operator definable amounts. For example, the alternative embodiment 122 can include the definable amounts $0.50, $1.00 and $5.00 as illustrated by the quick coin executors 120, 128 and 130, respectively. In an embodiment having a quick ticket feature, the alternative cash out menu 122 of FIG. 4 can include a plurality of different operator or player definable quick ticket executors, similar to executors 120, 128 and 130, each of which display and enable a different amount of money to be automatically printed onto or represented by a redeemable ticket or other amount recording device.

Figure 5:
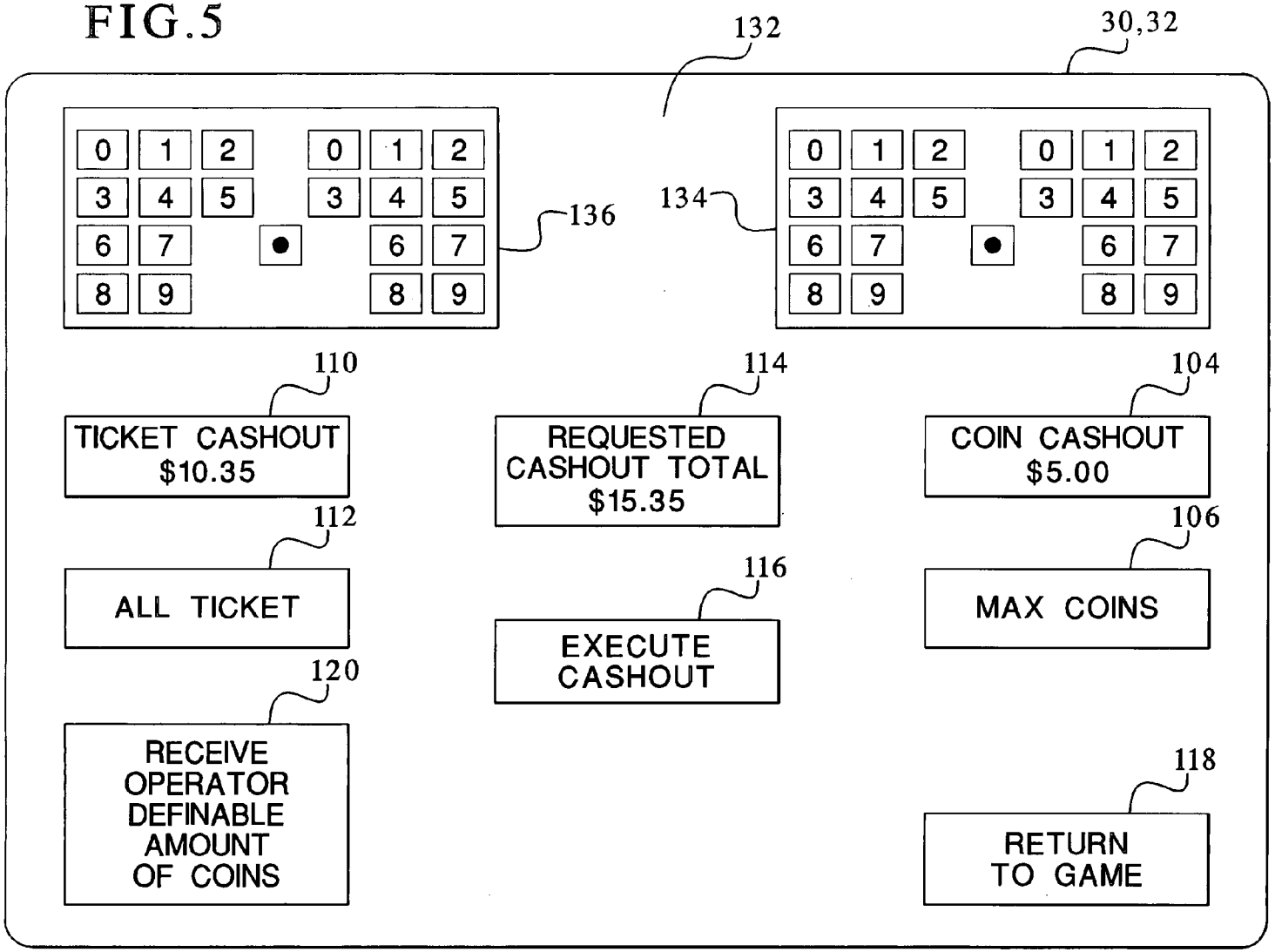
FIG. 5 is a front elevation view of a display device illustrating another alternative cash out menu embodiment of the present invention.

Referring now to FIG. 5, an enlarged front elevational view of the central display device 30 or the secondary display device 32 of FIGS. 1A and 1B, respectively, is shown illustrating an alternative cash out menu 132 of the present invention. The cash out menu 132 includes an alternative coin selector 134 and an alternative ticket selector 136. For illustration purposes, both selectors include the numerals 0 through 9 on either side of a decimal point. The implementor can configure the alternative selectors in many different ways. In each way, both alternative selectors enable the player to type in the desired amount rather than increment to the desired amount.

Typing in the desired amount can occur in a plurality of ways. The coin indicator 104 and ticket pay indicator 110 could display the player inputted values from right to left and automatically include the decimal point as is done in known automated teller machines (ATM's). The indicators can display the inputted values from left to right, wherein the player types the decimal point in the appropriate place. In this alternative embodiment 132 as well as in the previous embodiments 100 and 122, the present invention in one embodiment provides a suitable audio, visual or audiovisual message when the player inputs an unretrievable amount. The present invention can provide such a message immediately after the player enters the unretrievable amount. Alternatively, the present invention can provide such a message when the player attempts to execute the money retrieval via the cash out executor 116.

It should be appreciated that the present invention can provide a cash out menu having one or more of the features of the cash out menus 100, 122 and 132. For example, the present invention can include a cash out menu having the alternative coin selector 134 and the alternative ticket selector 136 in combination with the additional quick coin selectors 128 and 130. In another example, the present invention can provide the more coins selector 102 and the more ticket selector 108 for a predetermined period of input or until a predetermined amount is reached and then provide alternative coin selector 134 and the alternative ticket selector 136, after a larger desired retrieval becomes apparent. Each embodiment of the present invention in one embodiment includes a max coins selector 106, an all ticket selector 112, a total cash out display 114, a return to game or cancel executor 118 and at least one quick coin executor 120.

As described above with respect to the coin slot 12 and the bill acceptor 14 of FIGS. 1A and 1B, the gaming device 10 of the present invention can also include other devices for accepting payment, including readers or validators for credit cards, debit cards, smart cards, notes, and other amount recording devices. Although not illustrated, it should be appreciated from the above description, that the cash out menu screen of the present invention can be adapted to facilitate any of these alternative methods of payment, including a hand pay method wherein an operator pays an amount directly to the player, at the machine and without the need for a ticket redemption.

Referring again to FIG. 3, the present invention contemplates an alternative payment menu embodiment similar to the embodiment 100 wherein the alternative payment menu includes credit card, debit card, smart card, note, hand pay indicator or other amount recording devices in addition to or as a replacement for the ticketing apparatus. The alternative payment embodiment can include a more card selector, similar to the more ticket selector 108, that enables an operator definable amount to be credited to an alternative payment card. The alternative payment embodiment can also include a card indicator, similar to the ticket indicator 110, which displays the amount to be credited to the alternative payment card. The alternative payment embodiment can also include an all card selector, similar to the all ticket selector 112, which enables the player to set money that the player has currently available to the alternative payment card. As with the ticket pay, the player is enabled to make a total cashout to the alternative payment card.

The total cash out display 114 in this alternative embodiment includes a display of the amount to be credited to the alternative payment and paid to the player in coins. Likewise, the cash out executor 116 executes an alternative payment cash out along with any coin or ticket cash out desired by the player.

The present invention also contemplates the alternative payment embodiment including a quick card feature that enables the player to quickly credit an operator or player configurable amount to an alternative payment card. The alternative payment embodiment in such a case includes a quick card executor, similar to the executor 120, which in one embodiment displays the operator or player defined amount to the player. If the amount is player configurable, the alternative payment embodiment also includes a separate selector or selectors enabling the player to increment or type in a desired amount. As illustrated above, the operator can preset the card amount to be operator or player configurable. In the alternative cash out menu 122 of FIG. 4, the alternative payment embodiment can include a plurality of different operator or player definable quick card executors, similar to executors 120, 128 and 130, each of which display and enable a different amount of money to be automatically credited to the player's alternative payment card.

Referring again to FIG. 4, the present invention contemplates the alternative payment embodiment including all the features of the alternative cash out menu 122 of FIG. 4. The alternative payment embodiment includes a less card selector, similar to the selector 126, that enables a player to decrease, reverse or adjust a selected amount of money to be credited to an alternative payment card or other amount recording device. Referring to FIG. 5, the present invention contemplates the alternative payment embodiment including all the features of the alternative cash out menu 132 of FIG. 5. The alternative payment embodiment includes a selector, similar to the selector 136 that enables the player to type in the desired amount to be credited from the gaming machine to the player's alternative payment card or other amount recording device.

System of the Present Invention

Figure 6:
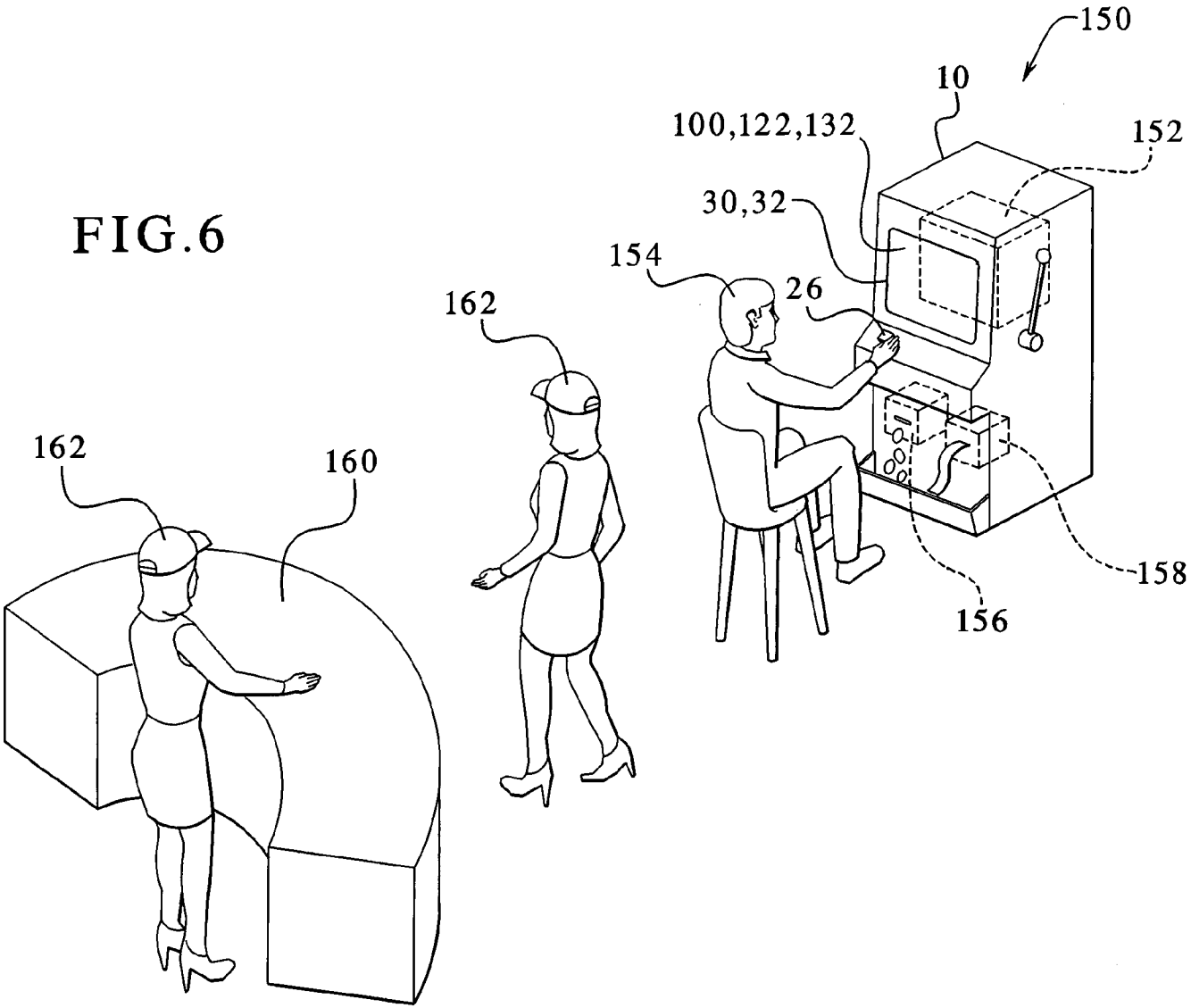
FIG. 6 is a top-front perspective view of a gaming establishment illustrating the money retrieval system employing the cash out menu of the present invention.

Referring now to FIG. 6, a top-front perspective view of a gaming establishment 150 having a money retrieval system employing the cash out menu of the present invention is illustrated. The gaming establishment in one embodiment includes a plurality of gaming devices, such as gaming device 10. The gaming device 10 includes one or both of the central display device 30, secondary display device 32, which communicate with the controller, illustrated schematically in FIG. 2 and shown figuratively and spatially here as the controller 152. One of the display devices 30 or 32 includes or displays one of the cash out menus 100, 122 or 132, or any combination thereof, when the player selects or pushes the cash out button 26. That is, the simulated or electromechanical cash out button 26 is in one embodiment the initial interface by which the player 154 inputs a desire to retrieve at least a potion of the player's money currently held by gaming device 10.

As described above in connection with FIGS. 3, 4 and 5, the present invention enables the player 154 to obtain some or all of the player's money in the form of coins or tokens or in the form of a ticket containing a printed redeemable amount of money. A well known coin issuer or hopper 156 communicates with the controller 152 and issues the appropriate amount of coins or tokens at the appropriate time. One coin issuer 156 in one embodiment handles all coin or token issues including selected coin issues, max coin issues and quick coin issues. A well known ticket issuer 158 communicates with the controller 152 and issues or prints out a ticket including the appropriate or selected amount of money at the appropriate time.

The player 154 receiving coins or cash from the money retrieval system of the present invention can thereafter use the cash as desired. Depending upon the rules of the gaming establishment 150, the player 154 receiving tokens from the money retrieval system of the present invention can typically use tokens the same as cash. If not, and in the case of the player 154 receiving a ticket from the money retrieval system of the present invention, the player 154 can thereafter redeem the ticket and or tokens at one or more cashier stations 160 conveniently located near the gaming devices. The player can leave the gaming device 10 and walk to the cashier stations 160, whereby the player redeems the ticket for the appropriate amount of money from an operator attendant 162. The player can alternatively input a ticket into a different gaming device (not illustrated) of the gaming establishment, wherein the new gaming device includes a ticketing system suitably adapted to receive and read the ticket.

The system of the present invention can also include some or all of the functions of the present invention at a central location such as over a local area network (LAN), wide area network (WAN), Internet connection, etc., as disclosed in connection with FIG. 2. The system network can link to service providers within the gaming establishment 150, such as restaurants, laundry facilities or cosmetic operations or systems such as barber shops or beauty shops. The system network can link to any service provided within the gaming establishment 150, including any associated hotel. The system network can link to outside or third party service providers such as restaurants, hotels or an airline.

Any of the cash out menus 100, 122 or 132 can thus contain features or selections that execute a request for services and/or products relating to those services via the LAN to the gaming establishment and associated hotel 150 or to any outside or third party service via the WAN. Although not illustrated, the features or selectors or the cash out menus 100, 122 and 132 can be included in one screen of the menus or on multiple screens, as desired by the implementor.

Method of the Present Invention

Figure 7B:
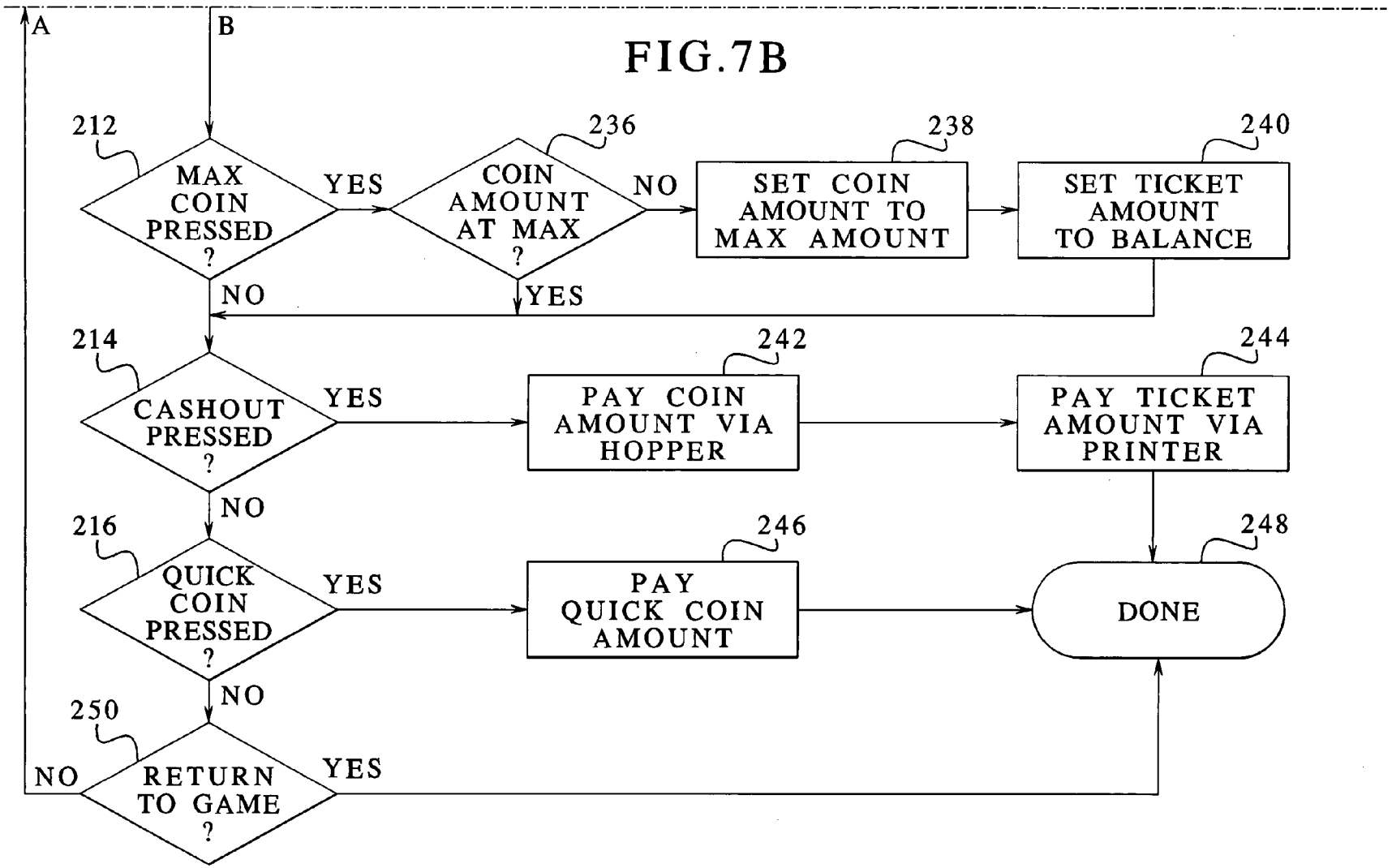
FIG. 7 is a schematic flow diagram illustrating an operating method of the cash out menu of the present invention.

Referring now to FIG. 7, a schematic flow diagram illustrating one operating method 200 of the money retrieval cash out embodiment 100 of FIG. 3 of the present invention is illustrated. FIGS. 3, 4 and 5, illustrating different cash out menu embodiments, provide the methodology for the individual selectors, indicators and executors. FIG. 7 illustrates one possible operating method for the cash out embodiment 100 of the present invention. It should be appreciated that those skilled in the art of computer programming and gaming device design can hereafter create many different but similar operating methods for the embodiments 122 and 132 of FIGS. 4 and 5. The following disclosure is not meant to limit the present invention to the operating method 200 described.

Referring now to the method 200, upon the player's selection of the cash out button, as indicated by the oval 202, the game displays a cash out menu of the present invention, as indicated by the block 204. According to the embodiment 100 of FIG. 3, after the cash out menu is displayed, the player can: (i) increment a ticket amount cash out as indicated by the diamond 206; (ii) select an all ticket cash out as indicated by the diamond 208; (iii) increment a coin amount cash out as indicated by the diamond 210; (iv) select a max coin cash out as indicated by the diamond 212; (v) execute a cash out as indicated by the diamond 214; or (vi) execute a quick coin cash out as indicated by the diamond 216.

Upon an input to increment a machine allowable amount of money for ticket pay, as indicated by a positive response to the query of diamond 206, the game determines whether the current inputted ticket amount is at a maximum level (e.g., total amount of player's money is already inputted), as indicated by the diamond 218. If the inputted ticket amount is at a maximum, as indicated by a positive response to the query of diamond 218, the game cycles to the remaining cash out options. If the inputted ticket amount is not at a maximum, as indicated by a negative response to the query of diamond 218, the game: (i) increments the ticket pay by one coin as indicated by the block 220; (ii) decreases the player's coin pay by one coin as indicated by the block 222; and (iii) cycles to the remaining cash out options.

Upon an input to select an all ticket cash out as indicated by a positive response to the query of diamond 208, the game determines whether the current inputted ticket amount is at a maximum level (e.g., total amount of player's money is already inputted), as indicated by the diamond 224. If the inputted ticket amount is at a maximum, as indicated by a positive response to the query of diamond 224, the game cycles to the remaining cash out options. If the inputted ticket amount is not at a maximum, as indicated by a negative response to the query of diamond 224, the game: (i) sets the amount of money for ticket pay to the player's current credit total (i.e., total indicated on the credit display 16 of FIGS. 1A and 1B) as indicated by the block 226; (ii) decreases the player's coin pay to zero as indicated by the block 228; and (iii) cycles to the remaining cash out options.

Upon an input to increment a payout tray defined denomination of money for coin pay, as indicated by a positive response to the query of diamond 210, the game determines whether the current inputted coin amount is at a maximum level (e.g., payout tray limit or total amount of player's money is already inputted), as indicated by the diamond 230. If the inputted coin amount is at a maximum, as indicated by a positive response to the query of diamond 230, the game cycles to the remaining cash out options. If the inputted ticket amount is not at a maximum, as indicated by a negative response to the query of diamond 230, the game: (i) increments the coin pay by one coin as indicated by the block 232; (ii) decreases the player's ticket pay by one coin as indicated by the block 234; and (iii) cycles to the remaining cash out options.

Upon an input to select a max coin cash out as indicated by a positive response to the query of diamond 212, the game determines whether the current inputted coin amount is at a maximum level (e.g., payout tray limit or maximum coin amount of player's money is already inputted), as indicated by the diamond 236. If the inputted coin amount is at a maximum, as indicated by a positive response to the query of diamond 236, the game returns the player to the remaining cash out options. If the inputted coin amount is not at a maximum, as indicated by a negative response to the query of diamond 236, the game: (i) sets the amount of money for coin pay to the maximum allowable (i.e., maximum increment of payout denomination of player's total indicated on the credit display 16 of FIGS. 1A and 1B or payout tray limit) as indicated by the block 238; (ii) sets the player's ticket pay equal to the player's total less the maximum coin payout amount as indicated by the block 240; and (iii) cycles to the remaining cash out options.

Upon an input to proceed with the selected cash out, as indicated by a positive response to the query of diamond 214, the game pays the player the selected coin pay in the coin payout tray 28 of FIGS. 1A and 1B, as indicated by the block 242, issues a ticket having the selected ticket amount to the player, as indicated by the block 244 and ends the cash out menu sequence, as indicated by the oval 248.

Upon an input to proceed with a quick coin cash out, as indicated by a positive response to the query of diamond 216, the game pays the operator/player selected quick coin amount in the coin payout tray 28 of FIGS. 1A and 1B, as indicated by the block 246 and ends the cash out menu sequence, as indicated by the oval 248. If the machine does not receive an input to proceed with the selected cash out, as indicated by a negative response to the query of diamond 214 or an input to proceed with a quick coin cash out, as indicated by a negative response to the query of diamond 216, the game cycles to the return to game query of the diamond 250.

Upon an input to return to the game, as indicated by a positive response to the query of diamond 250, the game ends the cash out menu sequence, as indicated by the oval 248. If the player does not select to return to the game, as indicated by a negative response to the query of diamond 250, the game cycles to the top of the loop, as indicated by the diamond 206, and repeats the above described method or process.

Additional Funds Transfer Modes and Combinations Thereof

Figure 8:
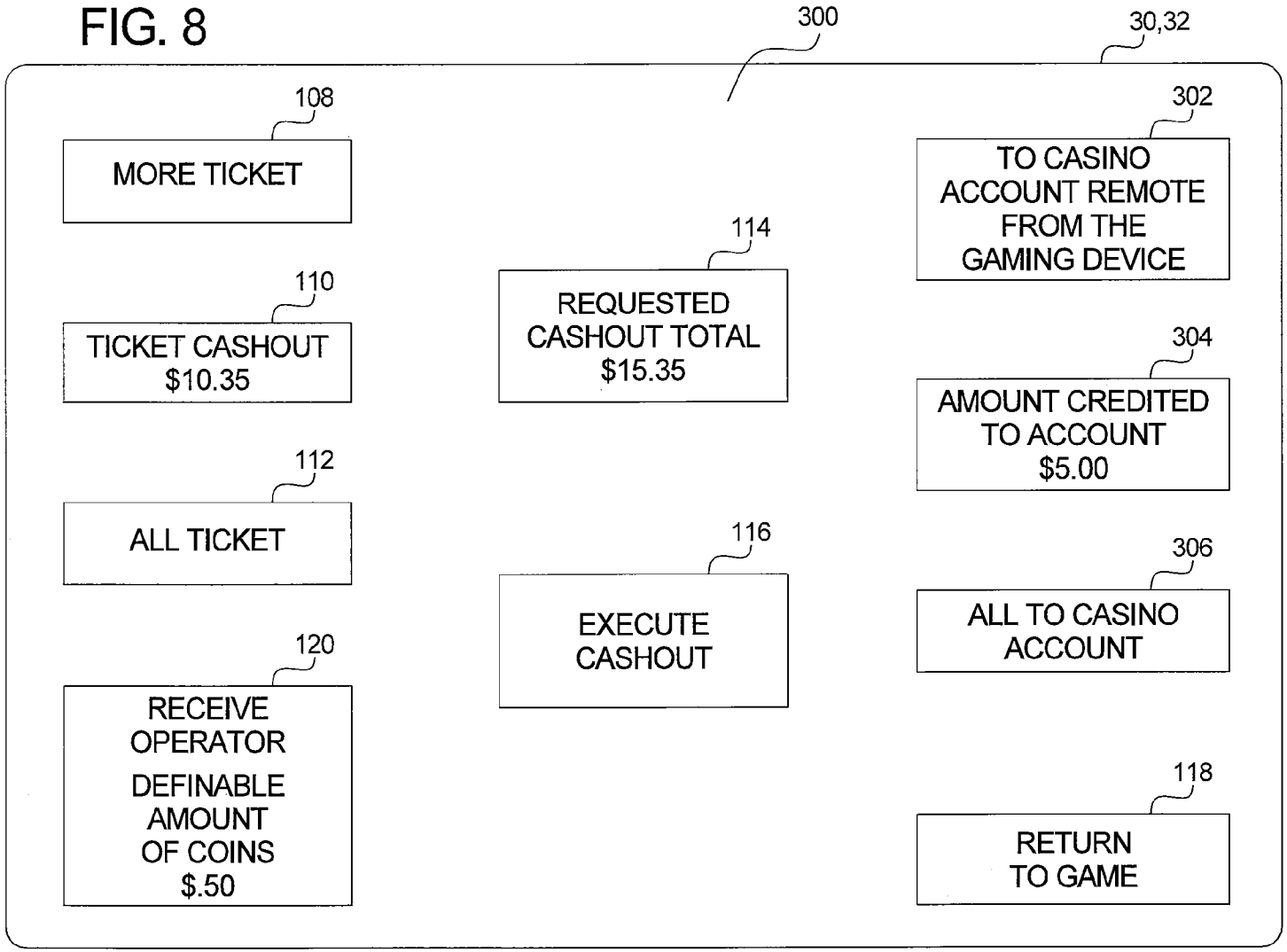
FIG. 8 is a front elevation view of a display device illustrating an alternative cash out menu embodiment the present invention, which employs a casino account as one form of payment.
Figure 9:
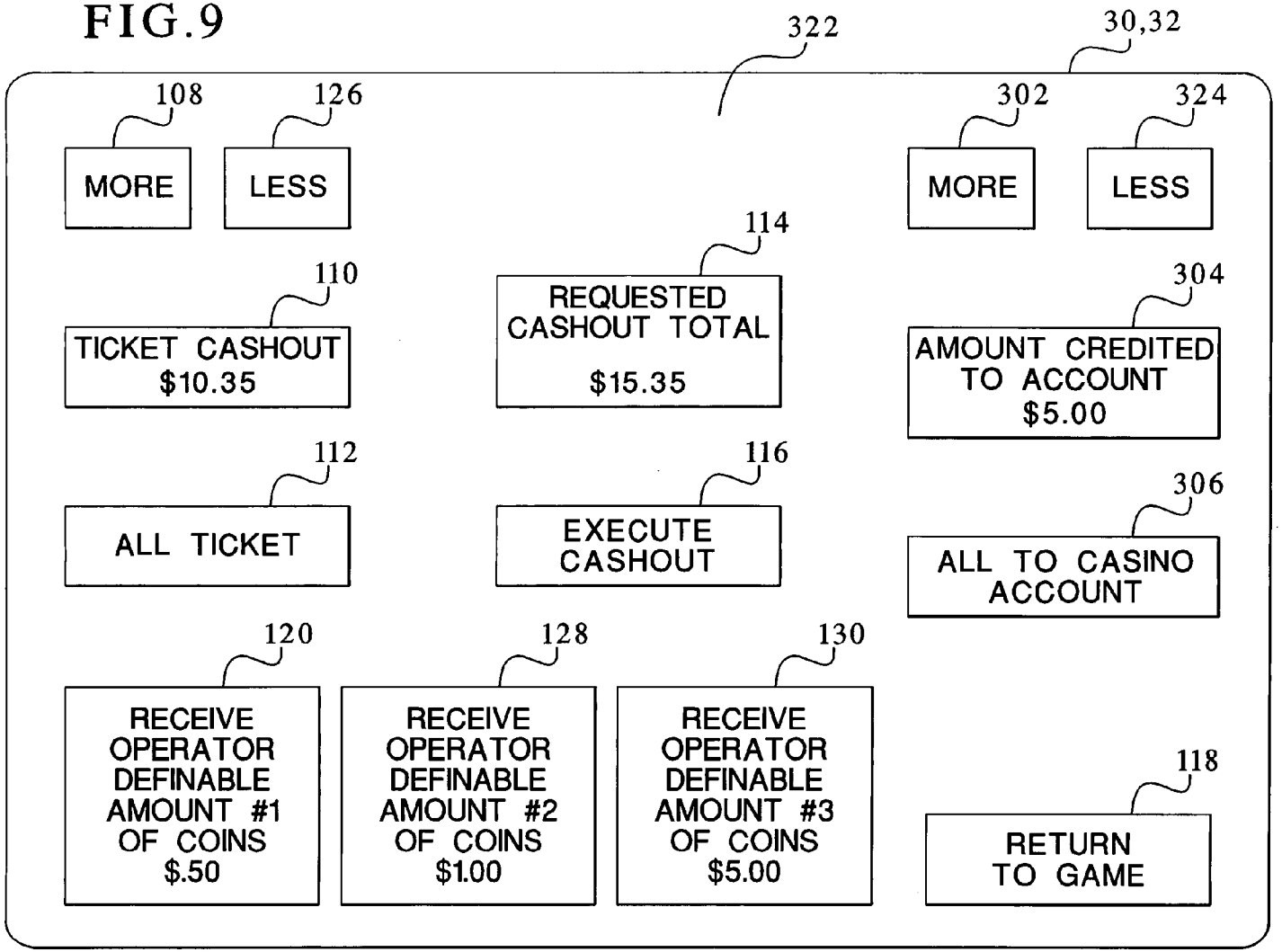
FIG. 9 is a front elevation view of a display device illustrating a further alternative cash out menu embodiment of the present invention, which employs a casino account.
Figure 10:
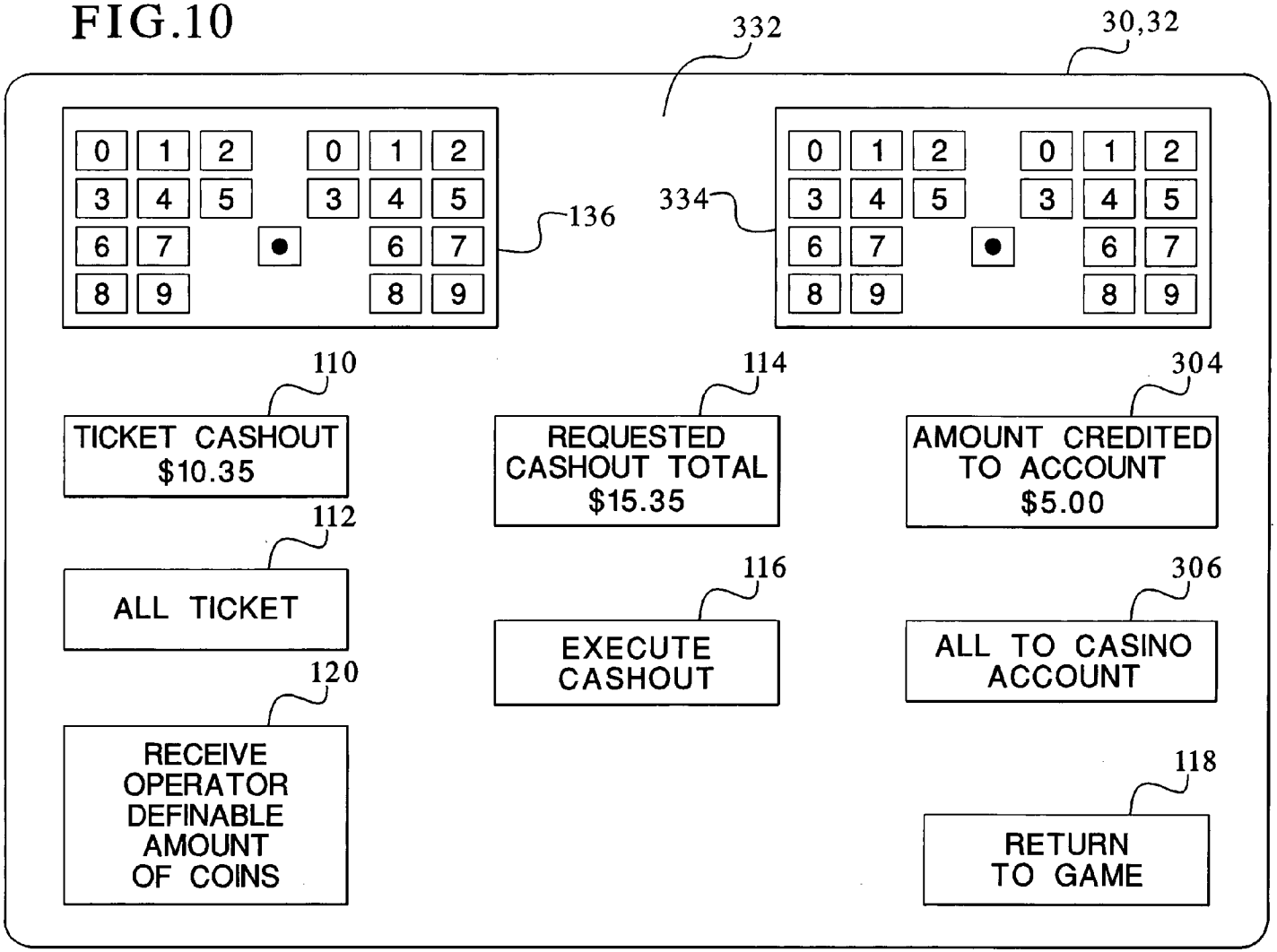
FIG. 10 is a front elevation view of a display device illustrating yet a further alternative cash out menu embodiment of the present invention, which employs a casino account.

Referring now to FIGS. 8 to 10, alternative embodiments of the cash out menu of the present invention are illustrated. As seen, the differences between FIGS. 8, 9 and 10 mirror to some extent the differences between FIGS. 3, 4 and 5. Indeed, each of the like reference numbers in FIGS. 3 to 5 and 8 to 10 operate the same and have each of the same alternatives as discussed above in connection with the embodiments of FIGS. 3 to 5 and wherever else those element numbers are discussed herein. The primary difference between the cash out menus of FIGS. 8 to 10 and those described above in connection with FIGS. 3 to 5 is that the coin cash out portions of the cash out menus of FIGS. 3 to 5 are replaced by a cash out mode in which a portion or all of the player's funds are transferred to a casino account, e.g., a credit or debit account, held by a casino cooperative entity that represents and includes one or multiple casinos or entities.

Cash out menu 300 of FIG. 8, for example, enables the player to increment or decrease the amount paid to the casino account remote from the gaming device via selectors 302 and 306. With cash out menu 300, like cash out menu 100, the gain of one form of payment necessarily dictates a loss of funds in another form of payment. That is, a cash out using cash out menu 300 is, in every case, a total cash out.

The "more to casino account" selector 302 increases the amount and percentage of the cash out credited to the casino account and at the same time decreases a like amount paid to a player on the alternative form, e.g., via a ticket. In turn, the more ticket input 108 increases the amount paid to the player in the form of a ticket and decreases the amount paid to the player's casino account.

The casino account as discussed in more detail below is maintained in one embodiment at the casino. The player when cashing out has the option to pay a portion or all of the cash out to the account and use that money at a later time. In one embodiment, the casino network links a select number of gaming devices from which the player can later play using the casino account funds. In another embodiment, each game or most all the games in the casino are networked, so that the player can play the same or different type of game later with funds from the casino account. In yet another embodiment, the casino network links the gaming devices and other product and service providers within the casino, so that the player can later retrieve the money stored on the casino account from a gaming device or other location, such as a restaurant, a shop, a hair salon, a laundromat, a movie theatre, a clothing store or any suitable other product, service hotel room accommodation provided by the casino.

In another embodiment, multiple casinos are networked, which may be commonly owned or otherwise formed in a partnership, so that funds credited at one gaming establishment are usable later at one or more different establishments. In the remote casinos, the player's credit can again be limited to certain gaming machines, all or most all gaming machines, or gaming and non-gaming uses within the casino. The casino account network can be a local area network or wide area network as needed. The casino account and cash out are accessible via an internet in one embodiment.

While FIGS. 8 to 10 are illustrated as coupling a ticket cash out with the casino account form of fund transfer, it should be appreciated that the casino account can be coupled with any one or more alternative forms of cash out discussed herein and in more detail below in connection with FIG. 12. FIGS. 8 to 10 each illustrate that the associated cash out menus provide a third form of payment, namely, coins or tokens from the quick coin or quick token executors, such as executors 120, 128 and 130. Additionally, and as shown in connection with FIG. 12, the cash out is alternatively or additionally provided on a player tracking card, a ticket, an ATM card/credit card, or via a hand pay.

Referring still to system 300 of FIG. 8, the amount currently selected by the player to be credited to the casino account is shown by indicator 304. That amount shown moves up or down, depending on whether the player selects the "more to casino account" input 302 or the more ticket input 108, respectively. If the player wishes to transfer all funds upon a cash out to the casino account, the player can select the "all to account" input 306. The all to account input automatically displays the player's total current accumulated credits on gaming device 10 in the amount credited to account display 304 and shows a zero balance in the ticket cash out display 110. Because the cash out is always a total cashout, the player's total accumulated credits are also displayed in requested cash out total display 114.

System 300 also includes the quick coin or quick token feature, as indicated by executor 120, which enables the player to obtain an operator definable amount of coins or tokens, such as fifty cents, with which the player can use to purchase an item or tip a casino worker. When the player has decided how much money to accept on a ticket and to send to the casino account, the player selects the cash out executor 116 to execute the cash out transaction. Any time prior to that selection, the player can select return to game input 118 and return to the wagering game of gaming device 10.

FIG. 9 illustrates an alternative embodiment cash out menu 322 that includes the "more to casino account" input 302 as well as a "less to casino account" input 324. Providing incrementing and decreasing inputs for each form of fund transfer (e.g., casino account and ticket) enables the cash out to be less than a total cash out if the player so desires. Again, the transfer of funds to a casino account can be coupled with any of the different forms of cash out and is not limited to the illustrated embodiment of cash out menu 322, wherein the casino account is coupled with a ticket.

Indicator 304 as above displays the amount that the player has currently selected to be credited to the casino account. Input 306 automatically sets the cash out to be a total cash out to the casino account and sets the ticket cash out to zero. As with FIG. 4, cash out menu 322 provides multiple quick coin executors 120, 128 and 130. It should be appreciated that executors 120, 128 and 130 are alternatively not provided in any of the menus 300, 322 and 332 and that eliminating such features does not alter the scope and spirit of the present invention.

System 332 of FIG. 10 shows an analogous cash out menu to FIG. 5 discussed above. Cash out menu 332 enables the player to key or type in an operator definable amount of money to credit to the casino account via keypad 334. A similar keypad 136 is provided for the ticket cash out. A combination of the different types of entry systems shown in menus 300, 322 and 332 is also possible. The amount credited display 304 and the all to account selector 306 are provided and operate as described above. One or more quick coin executors, such as executor 120, may also be provided. System 332 of FIG. 10, like system 322 of FIG. 9 can provide a partial cash out. That is, the player can upon a cash out transfer a portion of the player's funds to a ticket, a portion to the player's casino account, and still have credits remaining on credit display 16 with which the player can continue gaming.

Figure 11:
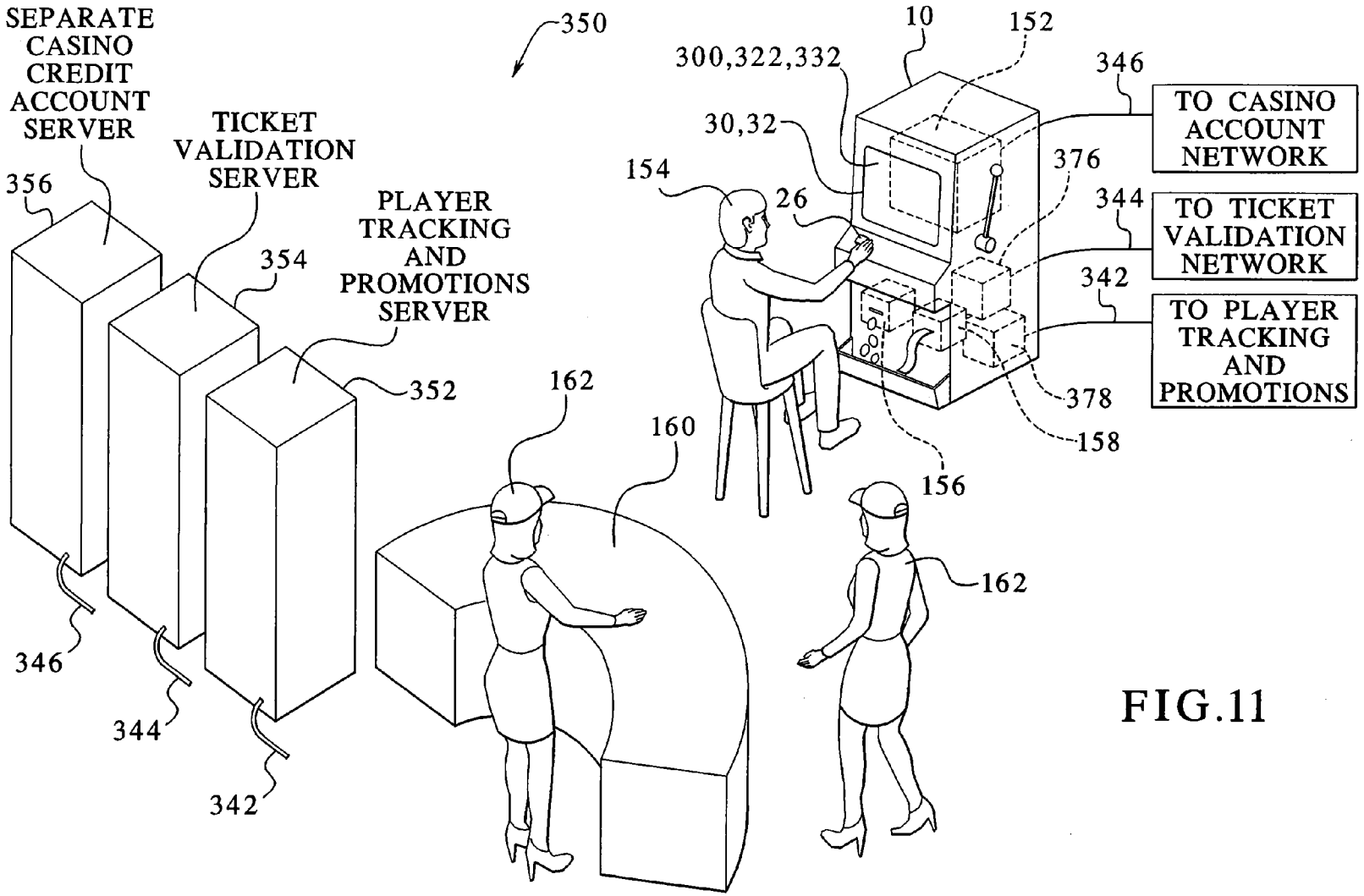
FIG. 11 is a top-front diagrammatic perspective view of a gaming establishment illustrating various networks and server computers for providing the multiple different forms of fund input and output transfers of the present invention.

Referring now to FIG. 11, diagrammatic view of parts of a gaming establishment 350 are illustrated having a fund transfer system employing one or more of the cash out menus 300, 322 or 332 described above. The gaming establishment includes a plurality of gaming devices, such as gaming device 10. Gaming device 10 includes one or both of the central display device 30 and secondary display device 32, which each communicate with controller 152 as described above.

One of the display devices 30 or 32 displays one of the cash out menus 300, 322 or 332 or any combination thereof, when the player selects or pushes cash out button 26. That is, the simulated or electromechanical cash out button 26 in one embodiment is the initial input by which player 154 selects to at least temporarily terminate the display of the wagering game and to instead display one of the cash out menus 300, 322 or 332. That is, when player 154 desires a partial or total cash out, player 154 presses initially cash out button 26 to display one of the menus of the present invention. As described above in connection with FIGS. 8 to 10, the menus 300, 322 and 332 enable player 154 to obtain some or all of the player's money in the form of a ticket and/or be credited to a casino account.

Once the menu 300, 322 or 332 is displayed, the player can select one of the quick coin executors 120, 128 or 130 to receive a number of coins or tokens issued via a coin issuer or hopper 156. If the player executes a cash out and transfers part of or all of the player's money to a ticket, a well-known ticket issuer 158 communicates with a ticket controller 376 and issues or prints out a ticket displaying a barcoded requested amount of money.

Gaming device 10 in one embodiment is linked to a central or server computer via a LAN, WAN or internet communication link as discussed above in connection with FIG. 2. The network can additionally link to service and product providers within gaming establishment 350, such as restaurants, laundry facilities, cosmetic operations, clothing stores, gift shops, beauty shops or any suitable other type of service or product or facility located in a casino. Such a network can extend to one or more adjacent or remote casinos via the network or to personal computers via an internet.

The casino account in one embodiment is managed by gaming establishment 350. In another embodiment, the account is managed at a remote location, which can be operated by the casino, a partner of the casino, or any entity having any suitable business relationship with gaming establishment 350.

FIG. 11 illustrates a number of different possibilities with which to network to the casino account of the present invention. FIG. 11 illustrates three possible networks, which are suitable for transferring money from gaming device 10 to and from such casino account. Any of the networks can be fiber optic networks, DSL cable, internet link and the like.

One possible network extends from a player tracking unit ("PTU") 378, which typically includes a component called a slot machine interface board. PTUs, such as PTU 378, have been provided for a number of years by at least the assignee of the present invention. PTU 378 provides a computer interface for player tracking, promotions and remote funding of machines. PTU 378 also interfaces between the controller of gaming device 10, such as controller 152, and a player tracking and promotions network 342.

Player tracking and promotions network 342 links a plurality of gaming devices, such as the gaming device 10 within gaming establishment 350 to a server computer 352 as shown in FIG. 11. Server computer 352 in turn operates with a man-machine interface to enable the casino to run the casino's player tracking programming, as well as to provide promotional giveaways, such as a free play buffet, a free play today, a free play Friday, a Happy Birthday promotion, a Happy New Year's or holiday promotion, as well as other suitable promotions. The promotions are printed out via ticket printer 158 in one embodiment as barcoded tickets, similar to the tickets issued by the ticketing system.

Player tracking network 342 provides one possible network for controlling, monitoring and running the casino account of the present invention. In addition to monitoring the player tracking points accumulated and used by the player, network 342 also accounts for the player's incoming and outgoing casino funds transfers. Using player tracking network 342 for a cash out, the player inserts the player's tracking card upon calling forth one of the menus 300, 322 and 332 described above. When the player executes the cash out, the menus provide a suitable confirmation to the player showing that the player's tracking card has an available balance adjusted by the amount of the cash out. A suitable receipt can also be printed from printer 158 confirming the transaction.

In one embodiment, a display similar to an ATM display can be accessed via the player tracking card, a PIN number and software contained within PTU 378 to show the player the player's current available balance on the player's player tracking card. The player can then bring the card to any other gaming device within casino 350 that accepts such card to access, upon entering the proper PIN, those funds. Further, different stores or service providers within the casino, as described above, may accept the player's tracking card as a form of payment for such goods or services.

Another possible network to use for the casino account is the ticket validation network 344, which links different gaming devices, such as gaming device 10, in one embodiment via a separate processor 376. It should be appreciated that in alternative embodiments, the ticket validation network 344 can also communicate with main game controller 152.

Ticket validation network 344 communicates with a ticket validation server 354, which in turn operates with a man-machine interface to enable casino personnel to operate the ticketing system. Ticket controller 376 further communicates with ticket issuer 158 to issue a ticket to the player. The player's casino account can additionally be maintained via the ticket validation network 344 and server computer 354. Here, when the player selects a cash out that includes a sum of money credited to the player's casino account, the player's account is adjusted accordingly and a receipt is printed from ticket printer 158 showing the credit transaction.

It is also possible that the ticket validation network 344 can communicate with gaming device 10 or the player tracking system to transfer credited funds to a card, such as the player tracking card or a separate casino cash/credit card discussed below. In one embodiment, the cross-communication is accomplished via a computer link between ticketing controller 376 and either the main game controller 152 or PTU 378.

FIG. 11 illustrates a further alternative network for controlling the casino account of the present invention. Here, a separate network 346 and separate server computer 356 are provided for the sole purpose of maintaining such account. The casino or multiple casino partnership issues a separate card to the player for maintaining the casino account. Network 346 links to multiple gaming devices, such as gaming device 10, as well as other service and product providers within casino 350 or the partnership of casinos. Additionally, network 346 can link via the internet to a personal computer.

The player in this latter embodiment may have two casino cards, one specifically for player tracking within the casino and another for maintaining a casino cash/credit account. The present invention contemplates expressly the provision of a casino cash/credit card, where the player at gaming device 10 can play with cash funds transferred from prior play or within a casino's credit limit. Such cash/credit card is usable in one embodiment in multiple places within the casino, as well as outside the casino.

The separate server computer 356 also communicates with a man-machine interface so that casino personnel can access information, such as the player's cash balance, credit limit, credit remaining, etc. Upon inserting the cash/credit card into gaming device 10, gaming device 10 can present a menu asking for the player's PIN and whether the player wishes to play with funds accumulated and stored on the card or via credit provided by the casino or partnership of casinos. The casino can offer an incentive to keep money on the card, such as additional casino credits or other promotional items discussed herein.

Figure 12:
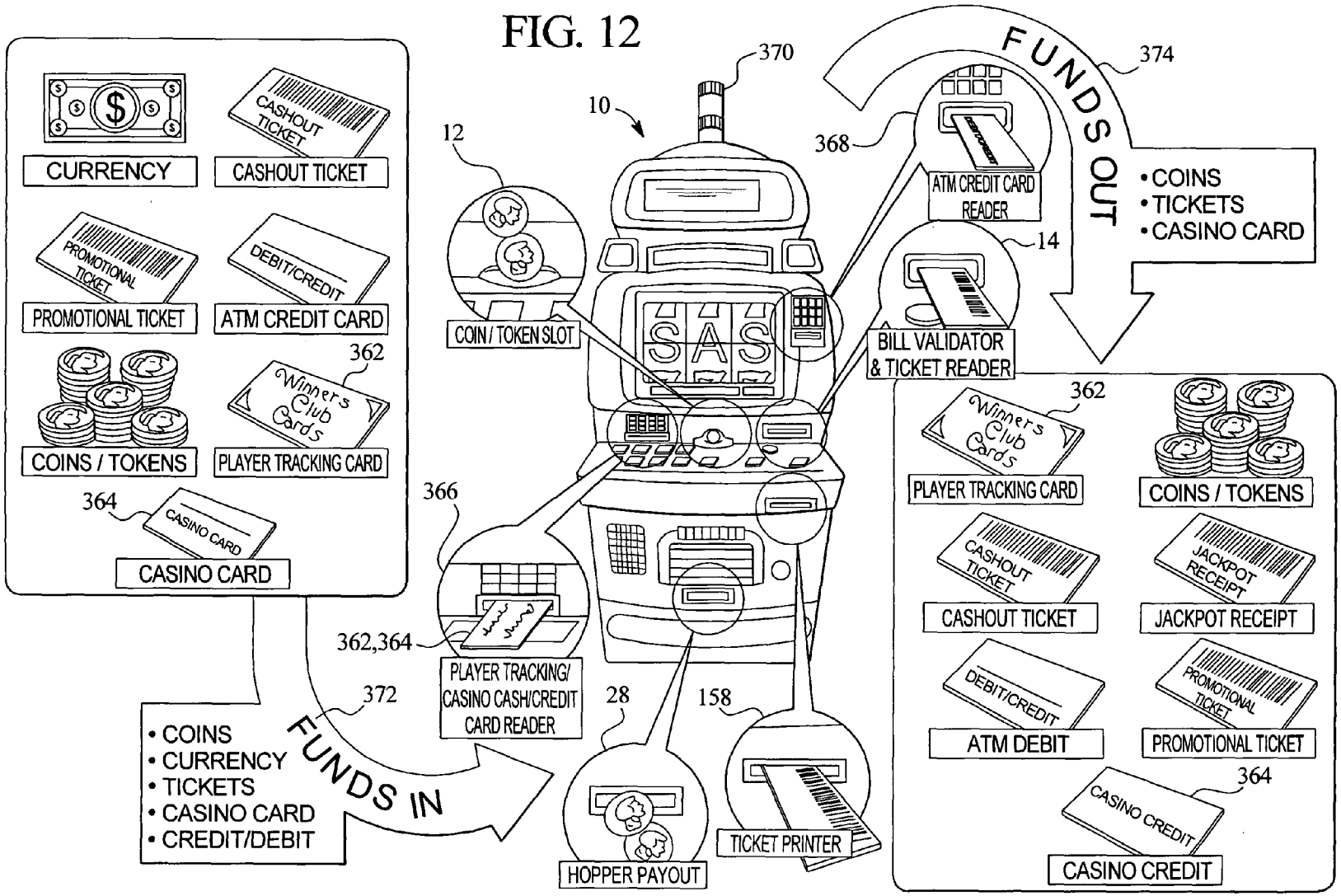
FIG. 12 is a schematic illustration summarizing some of the different fund input and output transfers and combinations thereof of the present invention.

Referring now to FIG. 12, a summary of the different advanced funds transfer system ("AFT") modes and combinations thereof of the present invention is graphically illustrated. One advantage of such system is that it is operator configurable to include any one, or more or all of the different possible AFT modes described herein. Furthermore, it is player selectable so that the player can use one of, some or all of the AFT modes as the player desires.

FIG. 12 illustrates schematically a gaming device, such as gaming device 10, which may be a slot machine, but which is alternatively any suitable type of gaming device, such as poker machine, a blackjack machine, a keno machine, a craps machine, a bingo machine, or the like or any combination thereof, etc. FIG. 12 illustrates via arrow 372 that there are multiple AFT modes for inputting funds into gaming device 10. As discussed above, gaming device 10 provides a coin slot 12 in one embodiment to accept coins or tokens. Gaming device 10 also includes a bill validator and ticket reader 14, which can accept a cash out ticket, described above, a promotional ticket (various ones of which were described above) or cash.

One network for controlling the casino account of the present invention discussed above is the player tracking network, which in FIG. 12 is shown as being accessible via location 366 on gaming device 10. A separate casino account card 364 is alternatively provided, which is dedicated to maintaining the player's casino cash/credit. That card 364, as illustrated in FIG. 12, can also be inserted into gaming device 10 at location 366, which in the illustrated embodiment is the same place in which the player's tracking card 362 is inserted. Another possible fund input source is the player's ATM bank debit or bank credit card, which is inserted at location 368 on gaming device 10.

FIG. 12 also shows a multitude of different output AFT modes, as indicated by arrow 374. The player can receive coins or tokens in hopper 28 as described above. The player can receive a portion or all of the player's money upon a cash out via a ticket, which is issued at ticket printer 158 shown in both FIGS. 11 and 12. The player alternatively receives a jackpot or promotional ticket via ticket printer 158. The tickets each have a barcode imprinted amount of money shown thereon, which can be redeemed at another gaming device with a ticket reader 14 or at a cashier, such as cashier 162 shown in FIG. 11.

As discussed above, the player can have funds transferred to the player's player tracking card 362 as part of the casino account of the present invention. To use such funds, the player inserts the player's tracking card 362 at location 366 on gaming device 10. If the casino crediting system is provided on a separate network and a separate casino account card 364 is issued to the player, the player inserts such card to use funds stored thereon again at location 366 on gaming device 10. It is also possible that the player can receive useable funds transferred via the player's ATM or credit card, wherein that card is inserted into gaming device 10 at location 368. One final way the player can receive funds upon a cash out is via a hand pay which is indicated by the flashing bulb 370 located on top of gaming device 10. Bulb 370 signals an operator to approach the gaming device and pay the player a desired amount.

The cash out menus described herein can be configured for any combination of AFT modes for both inputting funds and taking funds off gaming device 10. The present invention is expressly not limited to providing only two forms of payment, but rather, discloses a system that is operator-configurable to provide AFT modes desired by the operator. Moreover, in one embodiment, the cash out menus and systems employing those menus provide the operator selected AFT modes to the player in an optional format, so that the player is not forced to use a method of payment that is undesirable.

In one embodiment, the player is able to make a partial or total cash out split between multiple gaming devices 10. For example, it is common for a player to play two machines at once. Or, two people, such as a husband and wife, may share a single player tracking card 362 or casino account card 364. In any case, players who have a casino account may wish to transfer funds from one machine 10 to another without having to insert the tracking card 362 or casino card 364 multiple times into multiple machines to make such transfer. Accordingly, the present invention enables two or more machines 10 to be credited via the player's card 362 or 364, after which the player tracking network 342, ticket validation network 344 or separate casino network 346, which links the player's card 362 or 364 to a central server computer that tracks the player's casino account, enables funds to be transferred directly over the network 342, 344 or 346 between the two or more machines 10 without requiring the player to reinsert card 362 or 364 into the machines 10.

The present invention enables the player to load credits onto two or more machines 10 initially using the tracking card 362 or casino card 364, or alternatively, to load credits onto one machine 10 and simply insert the card 362 or 364 into another machine, so that both machines can come on-line with respect to the network 342, 344 or 346, after which the network recognizes the machines as being linked via the player's casino account. In any case, the player is then able to swap credits between linked machines 10 using the cash out function.

In one example, when the network 342, 344 or 346 knows that the player has credited or been linked to two or more machines 10 via the player's casino account, the network tells the machines upon a cash out to display a special screen having an option to transfer funds between the machines. In FIGS. 8 to 10, for example, screens 300, 322 and 332 could display, additionally or alternatively to one of the other forms of cash out, a "TO LINKED MACHINE" selector (not illustrated), and enable the player to increment the amount to the other machine via one of the modes displayed in FIGS. 8 to 10. The cash out screen could limit the transfer to two machines or provide a selection between two or more machines suitably marked, so that the player can decide between two or more machines or send split cash out proceeds to multiple machines.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device, said gaming device comprising:

a display device;

an input device, the input device including a cashout selector;

a processor; and a memory device storing a plurality of instructions, which when executed by the processor, cause the processor to operate with the display device and the input device to:

(i) enable a player to deposit money on the gaming device;

(ii) add the amount of money to a credit meter;

(iii) after each placement of a wager of an amount of money on a play of a wagering game by the player:

(a) deduct the wager from the credit meter, (b) display the play of the wagering game, and (c) add any amounts resulting from any winning outcomes from the play of the wagering game to the credit meter, such that after said play of the wagering game and before a subsequent play of the wagering game, the credit meter has a current total at that point in time;

(iv) if the player selects the cashout selector at a first point in time, the first point in time being after one of the plays of the wagering game, before a subsequent play of the wagering game and when the current total is greater than zero:

(a) display a cashout menu, the cashout menu simultaneously displaying at least two different cashout options, the at least two different cashout options including:

(i) a first cashout option including a payout to the player of a first amount of the current total of the credit meter at the first point in time and in a first payout form, and (ii) a second cashout option including a transfer of a second amount of the current total of the credit meter at the first point in time and to a casino account, the casino account being stored at a location remote from the gaming device, and wherein the first payout form is different than the casino account and the first and second amounts are both deducted from the current total of the credit meter at the first point in time, (b) simultaneously enable the player to select the first amount and the second amount, and (c) enable the player to execute the first cashout option and the second cashout option;

(v) after the player executes the first cashout option, if the first amount is greater than zero, provide the player the first amount in the first payout form; and (vi) after the player executes the second cashout option, if the second amount is greater than zero, transfer the second amount to the casino account stored at the location remote from the gaming device.

2. The gaming device of claim 1, wherein the wagering game is selected from the group consisting of: slot, poker, keno, blackjack, craps and bingo.

3. The gaming device of claim 1, wherein the first payout form is selected from the group consisting of: coins, tokens, a ticket, a credit card crediting, a debit card crediting, a promotional ticket, a jackpot ticket and any combination thereof.

4. The gaming device of claim 1, wherein the casino account is accessible via a player tracking card.

5. The gaming device of claim 1, wherein the casino account is communicated through a player tracking card network.

6. The gaming device of claim 1, wherein the casino account is accessible with a device different than a player tracking card.

7. The gaming device of claim 1, wherein the casino account is communicated through a network different than a player tracking card network.

8. The gaming device of claim 1, wherein the casino account is communicated through a ticketing network.

9. The gaming device of claim 1, wherein the casino account is accessible at multiple casinos.

10. The gaming device of claim 1, wherein the casino account is accessible for non-gaming purchases.

11. The gaming device of claim 1, wherein the casino account is accessible for transferring funds between multiple machines.

12. The gaming device of claim 1, wherein said the cashout menu includes a selector that enables the player to select the first amount.

13. The gaming device of claim 1, wherein the cashout menu includes a selector that enables the player to select the second amount.

14. The gaming device of claim 1, wherein the cashout menu includes input devices configured so that the first and second amounts do not necessarily add to a total cashout.

15. The gaming device of claim 1, wherein increasing the first amount automatically decreases the second amount and increasing the second amount automatically decreases the first amount.

16. The gaming device of claim 1, wherein the cashout menu includes a display of an addition of the first amount and the second amount.

17. The gaming device of claim 1, wherein the cashout menu includes a cancel selector that cancels the request.

18. The gaming device of claim 1, wherein the cashout menu includes a selector that returns the player to the wagering game.

19. The gaming device of claim 1, wherein the cashout menu includes a selector that enables the player to transfer funds between multiple machines.

20. The gaming device of claim 1, wherein the game is provided via a data network to a computer storage device.

21. The gaming device of claim 20, wherein the data network includes an internet.

22. A gaming device, said gaming device comprising:

a display device;

a cashout selector;

a processor; and a memory device storing a plurality of instructions, which when executed by the processor, cause the processor to operate with the display device and the cashout selector to:

(i) enable a player to deposit money on the gaming device;

(ii) add the amount of money to a credit meter;

(iii) after each placement of a wager of an amount of money on a play of a wagering game by the player:

(a) deduct the wager from the credit meter, (b) display the play of the wagering game, and (c) add any amounts resulting from any winning outcomes from the play of the wagering game to the credit meter, such that after said play of the wagering game and before a subsequent play of the wagering game, the credit meter has a current total at that point in time;

(iv) if the player selects the cashout selector at a first point in time, the first point in time being after one of the plays of the wagering game, before a subsequent play of the wagering game and when the current total is greater than zero:

(a) display a cashout menu, the cashout menu simultaneously displaying at least two different cashout options, the at least two different cashout options including:

(i) a first cashout option including a payout to the player of a first amount of the current total of the credit meter at the first point in time and in a first payout form, and (ii) a second cashout option including a transfer of a second amount of the current total of the credit meter at the first point in time and to a casino account, the casino account being stored at a location remote from the gaming device, and wherein the first and second amounts are both deducted from the current total of the credit meter at the first point in time, (b) simultaneously enable the player to select the first amount and the second amount, and (c) enable the player to execute the first cashout option and the second cashout option;

(v) after the player executes the first cashout option, if the first amount is greater than zero, provide the player the first amount on the ticket; and (vi) after the player executes the second cashout option, if the second amount is greater than zero, transfer the second amount to the casino account stored at the location remote from the gaming device.

23. The gaming device of claim 22, wherein the wagering game is selected from the group consisting of: slot, poker, keno, blackjack, craps and bingo.

24. The gaming device of claim 22, wherein the casino account is accessible via a player tracking card.

25. The gaming device of claim 22, wherein the casino account is communicated through a player tracking card network.

26. The gaming device of claim 22, wherein the casino account is accessible with a device different than a player tracking card.

27. The gaming device of claim 22, wherein the casino account is communicated through a network different than a player tracking card network.

28. The gaming device of claim 22, wherein the casino account is communicated through a ticketing network.

29. The gaming device of claim 22, wherein the first and second amounts are player selectable.

30. The gaming device of claim 22, wherein the casino account is accessible at multiple casinos.

31. The gaming device of claim 22, wherein the casino account is accessible for non-gaming purchases.

32. The gaming device of claim 22, wherein the casino account is accessible for transferring funds between multiple machines.

33. The gaming device of claim 22, wherein increasing the first amount automatically decreases the second amount and increasing the second amount automatically decreases the first amount.

34. A networking system for a plurality of gaming devices, said system comprising:

a plurality of gaming devices located at a gaming establishment, each gaming device configured to:

(i) enable a player to deposit money on the gaming device;

(ii) add the amount of money to a credit meter;

(iii) after each placement of a wager of an amount of money on a play of a wagering game by the player:

(a) deduct the wager from the credit meter, (b) display the play of the wagering game, and (c) add any amounts resulting from any winning outcomes from the play of the wagering game to the credit meter, such that after said play of the wagering game and before a subsequent play of the wagering game, the credit meter has a current total at that point in time;

a server computer and a communications link linking the server computer to the plurality of gaming devices; and a fund transfer account program stored by a memory device, said program executable by the server computer, for at least one of said gaming devices, to:

if the player selects a cashout selector at a first point in time, the first point in time being after one of the plays of the wagering game, before a subsequent play of the wagering game and when the current total is greater than zero:

(i) cause said gaming device to display a cashout menu simultaneously including at least two different cashout options, the at least two different cashout options including:

(a) a transfer of a first amount of the current total displayed by said gaming device at the credit meter at the first point in time and to a casino account stored at a location remote from the gaming device; and (b) a payout of a second amount of the current total of the credit meter at the first point in time and in a selected payout form, wherein the first amount may be retrieved at a later time and the first and second amounts are deducted from the current total of the credit meter at the first point in time, and (ii) simultaneously enable the player to select the first amount and the second amount.

35. The system of claim 34, wherein the server computer is located in the same establishment as the multiple gaming devices.

36. The system of claim 34, wherein the server computer is located in a different establishment than the multiple gaming devices.

37. The system of claim 34, wherein the communications link also communicates ticketing information to and from the gaming devices.

38. The system of claim 34, wherein the server computer also controls a player tracking program offered by the establishment.

39. The system of claim 34, wherein the communications link also communicates player tracking information from the gaming devices.

40. The system of claim 34, wherein the selectable payout form is selected from the group consisting of: coins, tokens, a ticket, a credit card crediting, a debit card crediting, a player tracking card crediting, a jackpot crediting and any combination thereof.

41. The system of claim 34, wherein the player is enabled to retrieve selectable portions of the first amount at the later time.

42. The system of claim 34, wherein the player is enabled to retrieve the first amount at one of the gaming devices.

43. The system of claim 34, wherein the player is enabled to retrieve the first amount at a location distinct from the gaming devices.

44. The system of claim 34, wherein the gaming device is a first gaming device, and wherein the first amount is able to be retrieved at a second gaming device.

45. The system of claim 44, wherein a portion of the first amount is able to be retrieved at a third gaming device.

46. The system of claim 44, wherein the player is a first player and the first amount is able to be retrieved at the second gaming device by a second player.

47. The system of claim 44, wherein the first amount is able to be retrieved at the second gaming device by the same player.

48. The system of claim 34, wherein the casino account is accessed via a card accepted by one of the gaming devices, and wherein the card is additionally accepted at locations within a gaming establishment that are distinct from the gaming devices.

49. The system of claim 34, wherein the card is additionally accepted at locations outside the gaming establishment.

50. The system of claim 34, which includes a ticketing system accessible through the gaming devices.

51. A method for operating a gaming device, said method comprising:

(a) enabling a player to place money on the gaming device;

(b) adding the amount of money to a credit meter;

(c) after each placement of a wager of an amount of money on a play of a wagering game by the player:

(i) deducting the wager from the credit meter, (ii) displaying the play of the wagering game, and (iii) adding any amounts resulting from any winning outcomes from the play of the wagering game to the credit meter, such that after said play of the wagering game and before a subsequent play of the wagering game, the credit meter has a current total at that point in time;

(d) enabling the player to select a cashout selector; and (e) if the player selects the cashout selector at a first point in time, the first point in time being after one of the plays of the wagering game, before a subsequent play of the wagering game and when the current total is greater than zero:

(i) displaying a cashout menu that simultaneously displays at least two different payout forms, each payout form having a selector, one of the payout forms including a transfer to a casino account stored at a location remote from the gaming device, and (ii) simultaneously enabling the player to:

(a) selected a first amount associated with cashout of the first amount of the current total of the credit meter at the first point in time in a first payout form by selecting the selector associated with the first payout form; and (b) select a second amount associated with a cashout of the second amount of the current total of the credit meter at the first point in time by a transfer to a casino account stored at the location remote from the gaming device by selecting the selector associated with the transfer to the casino account, wherein the first payout form is different than the casino account and both the first portion and the second portion are deducted from the current total of the credit meter at the first point in time;

(iii) enabling the player to request the cashout of the first amount and the cashout of the second amount;

(iv) after the player requests the cashout of the first amount, transferring the first portion of the current total of the credit meter at the first point in time to the player in the first payout form; and (v) after the player requests the cashout of the second amount, transferring the second portion of the current total of the credit meter at the first point in time to the casino account stored at the location remote from the gaming device.

52. The method of claim 49, which includes displaying on the menu the sum of the first portion and the second portion of the current displayed total of the credit meter.

53. The method of claim 49, which includes displaying on the menu an input that triggers payment of the current displayed total of the credit meter in the first form.

54. The method of claim 49, which includes displaying on the menu an input that triggers a crediting of the current displayed total of the credit meter to the casino account.

55. The method of claim 51, which includes enabling the player to transfer a third portion of the current displayed total of the credit meter to a different gaming device.

* * * * *

UNITED STATES PATENT AND TRADEMARK OFFICE

CERTIFICATE OF CORRECTION

PATENT NO. : 7,780,517 B2
APPLICATION NO. : 10/767243
DATED : August 24, 2010
INVENTOR(S) : Saffari et al.

It is certified that error appears in the above-identified patent and that said Letters Patent is hereby corrected as shown below:

IN THE CLAIMS:

In Claim 22, Column 25, Line 36, replace "the ticket" with --a ticket--.

In Claim 34, Column 26, Line 11, after "meter;" insert --and--.

In Claim 34, Column 26, Line 39, delete "and".

In Claim 34, Column 26, Line 43, delete "and".

In Claim 51, Column 28, Line 8, delete "and".

Signed and Sealed this

Sixteenth Day of November, 2010

David J. Kappos

David J. Kappos
*Director of the United States Patent and Trademark Office*